US012644192B2

(12) United States Patent
Ho et al.

(10) Patent No.: US 12,644,192 B2
(45) Date of Patent: Jun. 2, 2026

(54) CATALYST FOR SOLAR-DRIVEN ELECTROCATALYTIC OVERALL WATER SPLITTING AND METHODS OF MAKING AND USING THEREOF

(71) Applicant: City University of Hong Kong, Hong Kong (CN)

(72) Inventors: Johnny Chung Yin Ho, Hong Kong (CN); Quan Quan, Hong Kong (CN); Yuxuan Zhang, Hong Kong (CN); Wei Wang, Hong Kong (CN)

(73) Assignee: City University of Hong Kong, Hong Kong (HK)

( * ) Notice: Subject to any disclaimer, the term of this patent is extended or adjusted under 35 U.S.C. 154(b) by 648 days.

(21) Appl. No.: 18/183,288

(22) Filed: Mar. 14, 2023

(65) Prior Publication Data

US 2024/0309524 A1 Sep. 19, 2024

(51) Int. Cl.

| | |
|---|---|
| ***C25B 11/077*** | (2021.01) |
| ***C25B 9/17*** | (2021.01) |
| ***C25B 11/054*** | (2021.01) |
| ***C25B 11/061*** | (2021.01) |
| ***C25B 11/065*** | (2021.01) |

(52) U.S. Cl.

CPC ..... *C25B 11/077* (2021.01); *C25B 9/17* (2021.01); *C25B 11/054* (2021.01); *C25B 11/061* (2021.01); *C25B 11/065* (2021.01)

(58) Field of Classification Search

CPC .... C25B 1/04; C25B 1/55; C25B 9/17; C25B 11/052; C25B 11/054; C25B 11/057; C25B 11/06; C25B 11/065; C25B 11/075; C25B 11/077; C25B 11/091

See application file for complete search history.

(56) References Cited

PUBLICATIONS

Li, W-J, et al., 2024, Inorganic Chemistry Frontiers, 11, 6988-6997. <DOI: 10.1039/d4qi01851f> (Year: 2024).*

Vatutina, Y.V., et al., 2019, Catalysis Today, 329, 13-23. <https://doi.org/10.1016/j.cattod.2019.01.005> (Year: 2019).*

(Continued)

*Primary Examiner* — Brian A McCaig

(74) *Attorney, Agent, or Firm* — Heslin Rothenberg Farley & Mesiti P.C.

(57) ABSTRACT

Electrocatalytic overall water splitting to generate hydrogen and oxygen is a green and sustainable approach with zero carbon emission, which is important for the future renewable energy landscape. The practical application of this approach is challenging due to the sluggish reaction kinetics of water activation at high current densities, which are hard to overcome. Although high-performance alkaline bifunctional electrocatalysts may be useful, current catalysts lack both activity and durability. One approach is to rationally design bifunctional two-dimensional (2D) heterostructures but obtaining an efficient and durable catalyst has proved difficult. The present disclosure relates generally to an electrocatalyst including a 2D heterostructure (Ru-CMOP), methods of making and using the same. The catalyst of the present disclosure is designed for high activity and good durability at industrial-level high current densities.

20 Claims, 23 Drawing Sheets

(56) References Cited

PUBLICATIONS

An et al., "Epitaxial Heterogeneous Interfaces on N—NiMoO4/NiS2 Nanowires/Nanosheets to Boost Hydrogen and Oxygen Production for Overall Water Splitting", Advanced Functional Materials, vol. 29, 11 pages. 2019.
Anantharaj et al., "Precision and correctness in the evaluation of electrocatalytic water splitting: revisiting activity parameters with a critical assessment", Energy & Environmental Science, vol. 11, pp. 744-771. 2018.
Chala et al., "Hierarchical 3D Architectured Ag Nanowires Shelled with NiMn-Layered Double Hydroxide as an Efficient Bifunctional Oxygen Electrocatalyst", ACS Nano, vol. 14, pp. 1770-1782. 2020.
Deng et al., "Rational design of Schottky heterojunction with modulating surface electron density for high-performance overall water splitting", Applied Catalysis B: Environmental, vol. 299, 9 pages. 2021.
Doan et al., "Rational Engineering CoxOy Nanosheets via Phosphorous and Sulfur Dual-Coupling for Enhancing Water Splitting and Zn-Air Battery", Advanaced Functional Materials, 16 pages. 2020.
Fang et al., "Hierarchical Nanostructures: Design for Sustainable Water Splitting", Advanced Energy Materials, 25 pages. 2017.
Gong et al., "Ultrasmall and phase-pure W2C nanoparticles for efficient electrocatalytic and photoelectrochemical hydrogen evolution", Nature Communications, 8 pages. 2016.
Gu et al., "Two-Dimensional Porous Molybdenum Phosphide/Nitride Heterojunction Nanosheets for pH-Universal Hydrogen Evolution Reaction", Angew. Chem., vol. 133, pp. 2-11. 2021.
Guo et al., "TiN@Co5.47N Composite Material Constructed by Atomic Layer Deposition as Reliable Electrocatalyst for Oxygen Evolution Reaction", Advanced Functional Materials, 9 pages. 2020.
Guan et al., "Functionalized Hybridization of 2D Nanomaterials", Advanced Science, 32 pages. 2019.
Hoa et al., "Ruthenium single atoms implanted continuous MoS2—Mo2C heterostructure for high-performance and stable water splitting", Nano Engery, vol. 88, 11 pages. 2021.
Hoa et al., "Molybdenum and Phosphorous Dual Doping in Cobalt Monolayer Interfacial Assembled Cobalt Nanowires for Efficient Overall Water Splitting", Advanced Functional Materials, 12 pages. 2020.
Ji et al., "Graphene/MoS2/FeCoNi(OH)x and Graphene/ MoS2/FeCoNiPx multilayer-stacked vertical nanosheets on carbon fibers for highly efficient overall water splitting", Nature Communications, 13 pages. 2021.
Jiao et al., "Perfecting the Electrocatalysts via Imperfections: Towards Large-Scale Deployment of Water Electrolysis Technology", Energy & Environmental Science, 151 pages. 2021.
Kou et al., "Rational Design of Holey 2D Nonlayered Transition Metal Carbide/Nitride Heterostructure Nanosheets for Highly Efficient Water Oxidation", Advanced Energy Materials, 10 pages. 2019.
Kumar et al., "Modulating Interfacial Charge Density of NiP2—FeP2 via Coupling with Metallic Cu for Accelerating Alkaline Hydrogen Evolution", ACS Energy Letters, vol. 6, pp. 354-363. 2021.
Lei et al., "Efficient alkaline hydrogen evolution on atomically dispersed Ni—Nx Species anchored porous carbon with embedded Ni nanoparticles by accelerating water dissociation kinetics", Energy & Environmental Science, vol. 12, pp. 149-156. 2019.
Li et al., "Boosting oxygen evolution of single-atomic ruthenium through electronic coupling with cobalt-iron layered double hydroxides", Nature Communications, 11 pages. 2019.
Li et al., "Interfacial Electronic Coupling of Ultrathin Transition-Metal Hydroxides Nanosheets with Layered MXene as a New Prototype for Platinum-Like Hydrogen Evolution", Energy & Environmental Science, 10 pages. 2012.
Li et al., "Stress-Transfer-Induced In Situ Formation of Ultrathin Nickel Phosphide Nanosheets for Efficient Hydrogen Evolution", Angew. Chem. Int. Ed., vol. 57, pp. 13082-13085. 2018.
Li et al., "Nanostructured metal phosphides: from controllable synthesis to sustainable catalysis", Royal Society of Chemistry, 48 pages. 2021.
Li et al., "Doping β-CoMoO4 Nanoplates with Phosphorus for Efficient Hydrogen Evolution Reaction in Alkaline Media" ACS Applied Materials & Interfaces, vol. 10, pp. 37038-370045. 2018.
Liang et al., "Interfacing Epitaxial Dinickel Phosphide to 2D Nickel Thiophosphate Nanosheets for Boosting Electrocatalytic Water Splitting", ACS Nano, 10 pages. 2019.
Lin et al., "In-situ reconstructed Ru atom array on α-MnO2 with enhanced performance for acidic water oxidation", Nature Catalysis, vol. 4, pp. 1012-1023. Dec. 2021.
Luo et al., "Interface Engineering of Hierarchical Branched Mo-Doped Ni3S2/NixPy Hollow Heterostructure Nanorods for Efficient Overall Water Splitting", Advanced Energy Materials, 11 pages. 2020.
Luo et al., "Multifunctional 0D-2D Ni2P Nanocrystals-Black Phosphorus Heterostructure", Advanced Energy Materials, 9 pages. 2016.
Ma et al., "Highly efficient hydrogen evolution from seawater by a low-cost and stable CoMoP@C electrocatalyst superior to Pt/C", Energy & Environmental Science, vol. 10, pp. 788-798. 2017.
Mishra et al., "Hierarchical CoP/Ni5P4/CoP microsheet arrays as a robust pH-universal electrocatalyst for efficient hydrogen generation", Energy Environmental Science, vol. 11, pp. 2246-2252. 2018.
Ouyang et al., "Coupling Magnetic Single-Crystal Co2Mo3O8 with Ultrathin Nitrogen-Rich Carbon Layer for Oxygen Evolution Reaction", Angew. Chem. Int. Ed., vol. 59, pp. 11948-11957. 2020.
Qian et al., "Artificial Heterointerfaces Achieve Delicate Reaction Kinetics towards Hydrogen Evolution and Hydrazine Oxidation Catalysis", Angew. Chem. Int. Ed., 11 pages. 2020.
Quan et al., "Sequential self-reconstruction of localized Mo species in hierarchical carbon/Co—Mo oxide heterostructures for boosting alkaline hydrogen evolution kinetics and durability", Journal of Materials Chemistry A, vol. 10, pp. 3953-3962. Feb. 28, 2022.
Quan et al., "Self-Anti-Stacking !D Metal Phosphide Loop-Sheet Heterostructures by Edge-Topological Regulation for Highly Efficient Water Oxidation", Nano Micro Small, vol. 17, 11 pages. 2021.
Quan et al., "Confined carburization-engineered synthesis of ultrathin nickel oxide/nickel heterostructured nanosheets for enhanced oxygen evolution reaction", Nanoscale, vol. 11, pp. 22261-22269. 2019.
Riyajuddin et al., "Super-Hydrophilic Hierarchical Ni-Foam—Graphene-Carbon Nanotubes—Ni2P—CuP2 Nano-Architecture as Efficient Electrocatalyst for Overall Water Splitting", ACS Nano, vol. 15, pp. 5586-5599. 2021.
Wang et al., "Operando Spectral and Electrochemical Investigation into the Heterophase Stimulated Active Species Transformation in Transition-Metal Sulfides for Efficient Electrocatalytic Oxygen Evolution", ACS Catalysis, vol. 10, pp. 1855-1864. 2020.
Wang et al., "Bimetal Schottky Heterojunction Boosting Energy-Saving Hydrogen Production from Alkaline Water via Jrea Electrocatalysis", Advanced Functional Materials, vol. 30, 11 pages. 2020.
Wang et al., "Highly uniform Ru nanoparticles over N-doped carbon: pH and temperature-universal hydrogen release from water reduction", Energy & Environmental Science, vol. 11, pp. 800-806. 2018.
Wu et al., "Heterogeneous Bimetallic Phosphide Ni2P—Fe2P as an Efficient Bifunctional Catalyst for Water/Seawater Splitting", Advanced Functional Materials, 12 pages. 2020.
Xu et al., "Efficient Infrared-Light-Driven CO2 Reduction Over Ultrathin Metallic Ni-doped CoS2 Nanosheets", Angew. Chem. Int. Ed., vol. 60, pp. 8705-8709. 2021.
Yang et al., "Electronic Modulation of Hierarchical Spongy Nanosheets toward Efficient and Stable Water Electrolysis", Small, 10 pages. 2020.
Yu et al., "Hydrogen Generation from Seawater Electrolysis over a Sandwich-like NiCoN|NixP|NiCoN Microsheet Array Catalyst", ACS Energy Letters, vol. 5, pp. 2681-2689. 2020.

(56) References Cited

PUBLICATIONS

Yu et al., "Clean and Affordable Hydrogen Fuel from Alkaline Water Splitting: Past, Recent Progress, and Future Prospects", Advanced Materials, 35 pages. 2021.
Zhai et al., "Engineering active sites on hierarchical transition bimetal oxides/sulfides heterostructure array enabling robust overall water splitting", Nature Communications, 12 pages. 2020.
Zhang et al., "Phosphorus and Yttrium Codoped Co(OH)F Nanoarray as Highly Efficient and Bifunctional Electrocatalysts for Overall Water Splitting", Small, vol. 15, 9 pages. 2019.
Zhao et al., "Constructing Atomic Heterometallic Sites in Ultrathin Nickel- Incorporated Cobalt Phosphide Nanosheets via a Boron-Assisted Strategy for Highly Efficient Water Splitting", Nano Letters, vol. 21, pp. 823-832. 2021.
Zhao et al., "Synergistically Interactive Pyridinic-N—MoP Sites: Identified Active Centers for Enhanced Hydrogen Evolution in Alkaline Solution", Angew. Chem. Int. Ed., vol. 58, pp. 2-11. 2019.
Quan et al., "Topochemical domain engineering to construct 2D mosaic heterostructure with internal electric field for high-performance overall water splitting", Nano Energy, vol. 101, 8 pages. 2022.

* cited by examiner

CATALYST FOR SOLAR-DRIVEN ELECTROCATALYTIC OVERALL WATER SPLITTING AND METHODS OF MAKING AND USING THEREOF

FIELD

The present disclosure relates generally to electrochemical overall water splitting and, more specifically, to catalysts for solar-driven electrochemical overall water splitting and methods of making and using thereof.

BACKGROUND

Electrocatalytic overall water splitting to generate hydrogen and oxygen is a green and sustainable approach with zero carbon emission. However, the sluggish reaction kinetics of water activation are challenging to overcome and current catalysts lack good efficiency and durability at large current densities. Efficient strategies to realize high-performance alkaline bifunctional electrocatalysts for industrial-scale water-splitting devices are currently lacking.

Heterostructure construction via judiciously designing heterointerfaces has emerged as an effective method to promote intrinsic activity for surface-mediated electrochemical reactions. For example, a two-dimensional (2D) nanosheet structure with a high specific surface area increases the accessible surfaces during the liquid-phase catalytic reaction. A 2D phosphide-based heterostructure may be obtained through a partial phosphorization treatment to construct an assembler with the generated phosphide onto the surface of 2D metal-based precursors. However, the phosphide bulks have a high surface energy and generally huddle on the surface of the 2D precursor, which creates another integrated surface by shielding the interfacial heterojunctions from participating in chemical reactions and limiting the reaction kinetics.

SUMMARY

The present disclosure offers advantages, benefits, and other alternatives over known compositions and methods, by providing a catalyst for solar-driven electrochemical overall water splitting, methods of making and using thereof, that are efficient and durable.

In an aspect, provided is a method of making a catalyst including: (i) forming a plurality of Ru-doped $CoMoO_4$ nanosheets on a support by a solvothermal process; and (ii) treating the plurality of Ru-doped $CoMoO_4$ nanosheets with a phosphorous source to create phosphide nanodomains, wherein the solvothermal process includes providing a support, mixing a Co source, a Mo source, and a Ru source to form a first solution; heating the solution and support together at a temperature in the range from about 160 to 180° C. for about 10 to 12 hours; and cooling the supported $CoMoO_4$ nanosheets to room temperature.

In an example, the support may be a nickel foam or a carbon fiber paper. In another example, the Co source may be a water-soluble cobalt salt, such as cobalt nitrate hexahydrate ($Co(NO_3)_2 \cdot 6H_2O$). In yet another example, the Mo source may be a water-soluble molybdate salt, such as ammonium molybdate tetrahydrate ($(NH_4)_6Mo_7O_{24} \cdot 4H_2O$). In a further example, Ru source may be ruthenium chloride hydrate ($RuCl_3 \cdot_x H_2O$).

In an example, treating the plurality of Ru-doped $CoMoO_4$ nanosheets with a phosphorous source to create phosphide nanodomains may include annealing the supported Ru-doped $CoMoO_4$ nanosheets and a phosphorous source at a temperature in the range from about 280 to 300° C. for about 1 to 2 hours under Ar atmosphere at a ramping rate of about 5° C. min-1 and cooling to room temperature. In another example, the phosphorous source may be a hypophosphite, such as sodium hypophosphite $NaH_2PO_2$. In yet another example, the phosphide nanodomains may have an average diameter of about 4 to about 8 nm. In still another example, the treated Ru-doped $CoMoO_4$ nanosheet array may have a thickness of about 10 to 15 nm.

In an aspect, provided is a catalyst including: a support, a plurality of Ru-doped $CoMoO_4$ nanosheets arrays assembled on the support, and a plurality of phosphide nanodomains on the Ru-doped $CoMoO_4$ nanosheet arrays. In an example, (i) the support may be a nickel foam or a carbon fiber paper; (ii) the phosphide nanodomains may have an average diameter of about 4 to 8 nm; and (iii) the catalyst may have a thickness of about 10 to 15 nm.

In as aspect, provided is an electrolyzer including a cathode including Ru-CMOP and an anode including Ru-CMOP. In an example, the electrolyzer may further include a solar cell. In another example, the Ru-CMOP may include: a support; a plurality of Ru-doped $CoMoO_4$ nanosheet arrays assembled on the support; and a plurality of phosphide nanodomains on the Ru-doped $CoMoO_4$ nanosheet arrays. In yet another example, (i) the support may be a nickel foam or a carbon fiber paper, (ii) the phosphide nanodomains may have an average diameter of about 4 to 8 nm; and (iii) the catalyst may have a thickness of about 10 to 15 nm. In still another example, the Ru-CMOP may exhibit (i) overpotentials of about 114±5 mV at −100 mA $cm^{-2}$ and about 183±10 mV at −500 mA $cm^{-2}$ for hydrogen evolution reaction; and (ii) overpotentials of about 286±5 mV at 100 mA $cm^{-2}$ and about 351±10 mV at 500 mA $cm^{-2}$ for oxygen evolution reaction. In a further example, the Ru-CMOP may be durable at about 250±10 mA $cm^{-2}$ for about 100 to 120 hours.

BRIEF DESCRIPTION OF THE FIGURES

These and other features, aspects, and advantages of the present disclosure will become better understood when the following detailed description is read with reference to the accompanying drawings, wherein.

Figure 1:
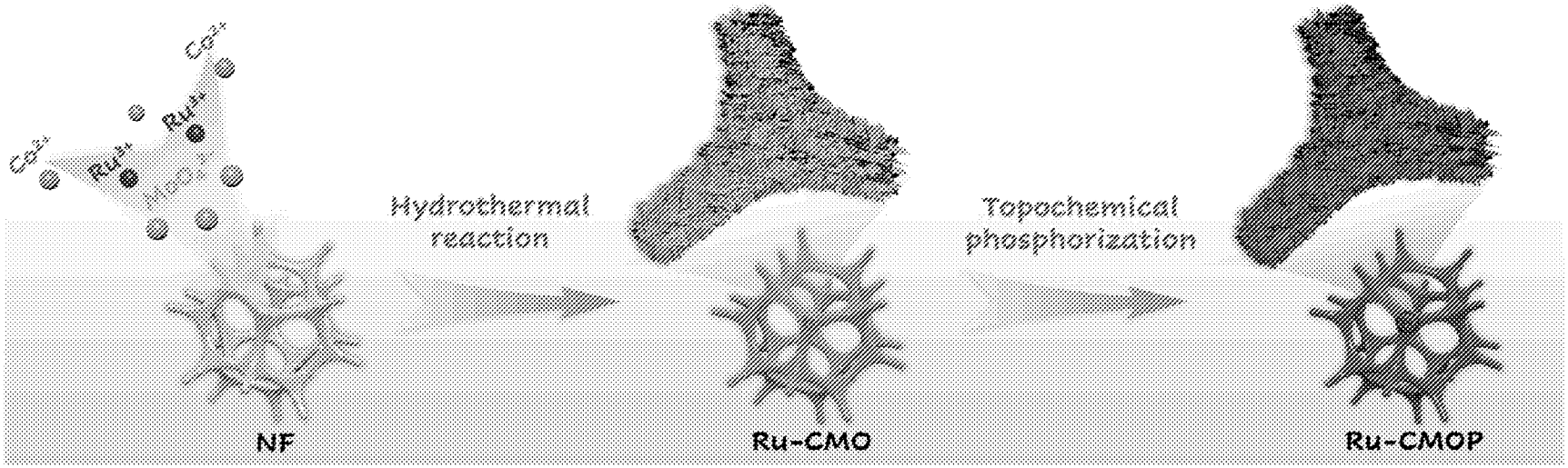
FIG. 1 is a schematic illustration of the preparation process of Ru-COMP.

It should be appreciated that all combinations of the foregoing concepts and additional concepts discussed in greater detail below (provided such concepts are not mutually inconsistent) are contemplated as being part of the inventive subject matter disclosed herein and may be used to achieve the benefits and advantages described herein.

DETAILED DESCRIPTION

According to an aspect of the present disclosure, there is provided a controllable phosphorization process to in-situ produce ultrafine Ru-doped CoMoP nanodomains (Ru-CMP) uniformly dispersed on the Ru-doped $CoMoO_4$ nanosheet arrays (Ru-CMO) to construct a heterostructure (denoted as Ru-CMOP) for highly efficient overall water splitting at high current density. Using this method, (i) the generated ultrafine Ru-CMP nanodomains with uniform distribution can activate the basal planes and create rich phase boundaries on 2D Ru-CMO nanosheets to increase the number of active sites; (ii) the created heterointerfaces can form a built-in electric field and the active Ru species can also optimize the electronic structure, synergistically facilitating the electron transfer; and (iii) the interconnected heterostructured nanosheet assemble as 3D multi-porous arrays can expedite the continuously produced gas bubble escape from the active sites to strengthen mechanical stability.

For the construction of a heterointerface, the charge accumulation is generated at the two phases. In other words, a highway for continuous electron transport between the two phases is established. Therefore, constructing strong heterointerfaces can facilitate the electron transfer within the 2D heterostructure to accelerate the efficiency of electrocatalytic water splitting.

The surface chemical configuration of 2D heterostructures may be designed to transform the inert basal planes into abundant active sites. For example, elaborately downsizing secondary phosphide building blocks onto the surface of nanosheet precursors (e.g., nanodomain modulation) provides a feasible approach for designing a 2D phosphide-based heterostructure with abundant phase boundaries and exposed active sites to boost the surface-mediated reaction kinetics. The freestanding 2D heterostructure nanosheets or nanoplates generally possess a loose structure and tend to aggregate at high temperatures or during the catalytic process with the desorption of adsorbed species or functional groups. 3D porous micro-nanostructure, with high electrical conductivity and tunable porous structure, may be used as a substrate (e.g., commercial nickel foam (NF)) under proper surface modification to build highly active electrocatalysts. Growing vertically aligned 2D heterostructure nanosheets on the skeleton of NF can form a uniform 3D array structure, which features abundant multi-level porosity as open channels for mass diffusion and gas release, thereby endowing a large contact area with electrolyte to further promote the electrocatalytic activity and preventing structure destruction from the bubble accumulation to strengthen the mechanical stability. Therefore, the growth of 2D heterostructures on well-conductive substrates directly served as electrodes may make commercial use applicable.

The as-obtained Ru-CMOP exhibits a hydrogen evolution reaction (HER) activity with overpotentials of 114 and 183 mV at −100 and −500 mA cm$^{-2}$, respectively, and an oxygen evolution reaction (OER) activity with overpotentials of 286 and 351 mV at 100 and 500 mA cm$^{-2}$, respectively. The electrocatalyst also has long-term stability under strong reducing/oxidating conditions. Additionally, when employed as a bifunctional catalyst for alkaline water splitting, the Ru-CMOP delivers cell voltages of 1.697 V and 1.828 V at 100 mA cm$^{-2}$ and 500 mA cm$^{-2}$, respectively, with outstanding durability at 250 mA cm$^{-2}$ for 120 h. Further, a solar-cell-driven overall water-splitting device is constructed to demonstrate its effective and robust practical operation.

Synthesis and Characterization of Ru-CMOP Heterostructure

According to an aspect of the present disclosure, there is provided a method of making a catalyst, including forming a plurality of Ru-doped $CoMoO_4$ nanosheets on a support by a solvothermal process, and treating the plurality of Ru-doped $CoMoO_4$ nanosheets with a phosphorous source to create phosphide nanodomains. In another example, the solvothermal process includes providing a support, mixing a Co source, a Mo source, and a Ru source to form a first solution, heating the solution and support together at a temperature in the range from about 160 to 180° C., including all ranges and subranges therein, e.g., about 160° C. to about 170° C., about 170° C. to about 180° C., about 160° C. to about 165° C., about 165° C. to about 170° C., about 170° C. to about 175° C., about 175° C. to about 180° C., etc., for about 10 to 12 hours, including all ranges, subranges, and values therein, e.g., about 10 hours to about 11 hours, about 11 hours to about 12 hours, about 10 hours to about 10.5 hours, about 10.5 hours to about 11 hours, about 11 hours to about 11.5 hours, about 11.5 hours to about 12 hours, etc., and cooling the supported $CoMoO_4$ nanosheets to room temperature.

In an example, the support may be a nickel foam or a carbon fiber paper. In another example, the Co source may be a water-soluble cobalt salt. Non-limiting examples of a water-soluble cobalt salt include cobalt nitrate hexahydrate ($Co(NO_3)_2 \cdot 6H_2O$), cobalt chloride hexahydrate ($CoCl_2 \cdot 6H_2O$), and the like. In yet another example, the Mo source may be a water-soluble molybdate salt. Non-limiting examples of water-soluble molybdate salt include ammonium molybdate tetrahydrate ($(NH_4)_6Mo_7O_{24} \cdot 4H_2O$), sodium molybdate dihydrate ($Na_2MoO_4 \cdot 2H_2O$), and the like. In still another example, the Ru source may be ruthenium chloride hydrate ($RuCl_3 \cdot_x H_2O$).

In an example, treating the plurality of Ru-doped $CoMoO_4$ nanosheets with a phosphorous source to create phosphide nanodomains includes annealing the supported Ru-doped $CoMoO_4$ nanosheets and a phosphorous source at about 280 to 300° C., including all ranges and subranges therein, e.g., about 280° C. to about 290° C., about 290° C. to about 300° C., about 280° C. to about 285° C., about 285° C. to about 290° C., about 290° C., to about 295° C., about 295° C. to about 300° C., etc., for about 1 to 2 hours, including all ranges, subranges, and values therein, e.g., about 1 hour to about 1.5 hours, about 1.5 hours to about 2 hours, etc., under Ar atmosphere at a ramping rate of about 5° C. $min^{-1}$ and cooling to room temperature.

In an example, the phosphorous source is may be a hypophosphite. Non-limiting examples of a hypophosphite include sodium hypophosphite ($NaH_2PO_2$), potassium hypophosphite ($KH_2PO_2$), and the like.

The Ru-CMOP heterostructure may be synthesized through a facile two-step procedure, an example of which is illustrated in FIG. 1. The Ru-doped $CoMoO_4$ nanosheet arrays (Ru-CMO) may be grown on nickel foam (NF) via a hydrothermal reaction with precisely controlled Ru doping, then subjected to a controllable phosphorization treatment through a facile gas-solid reaction. As a result, the Ru doped CoMoP nanodomains (Ru-CMP) are generated in-situ on the surface of Ru-CMO nanosheets.

Figure 2A:
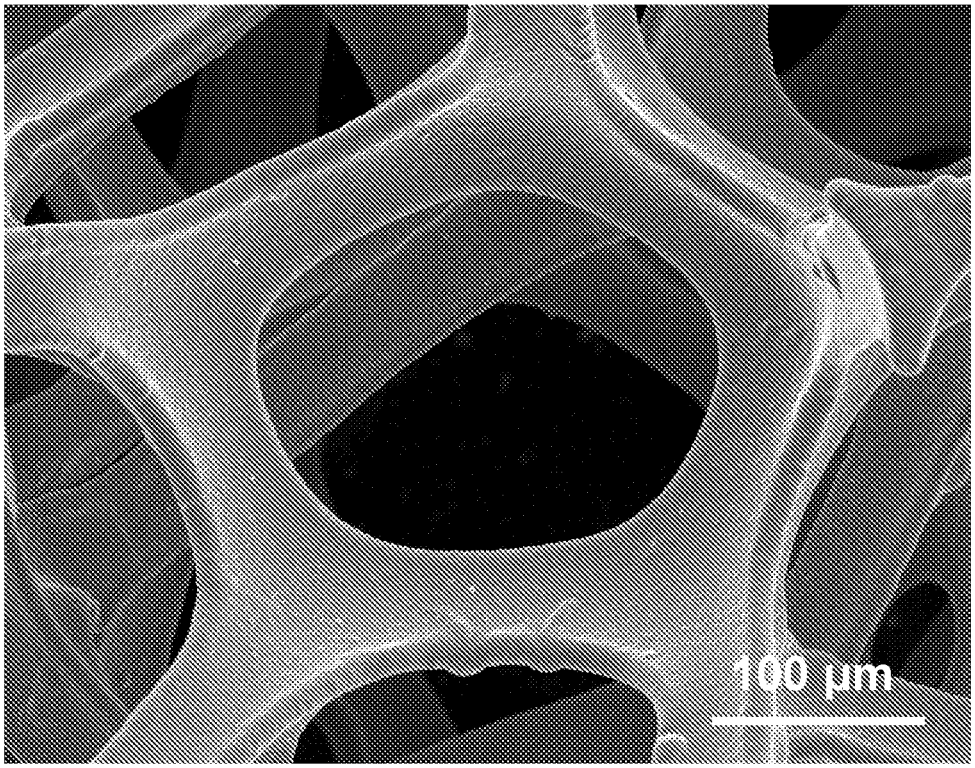
FIG. 2A is a scanning electron microscopy (SEM) image of the bare nickel foam.
Figure 2B:
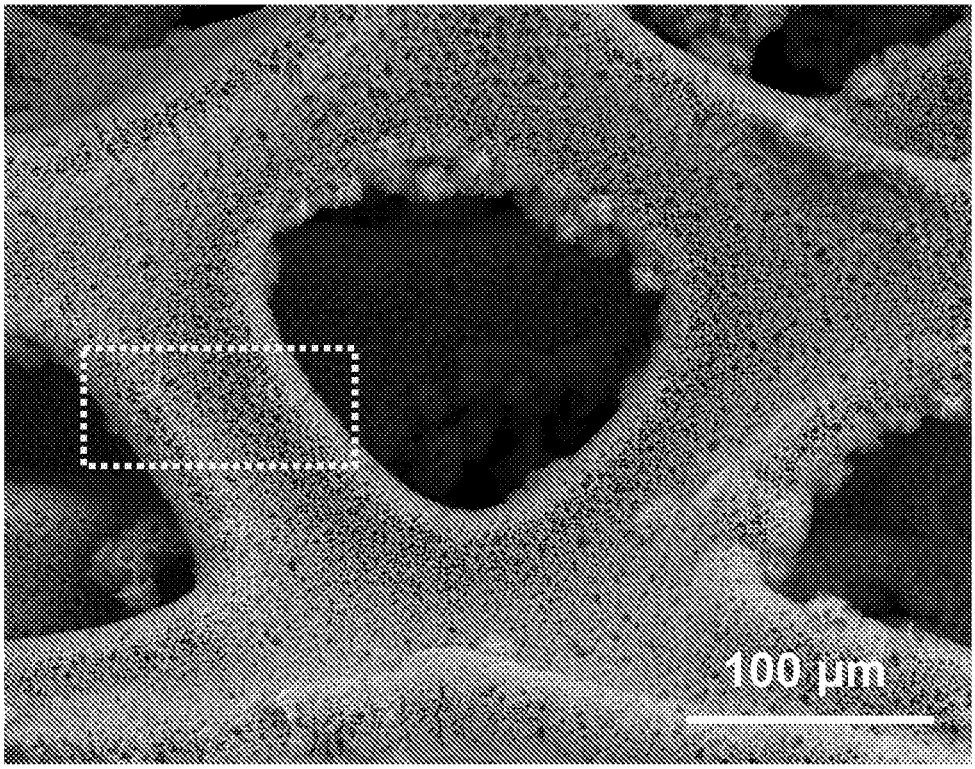
FIG. 2B is an SEM image of the Ru-CMOP nanosheet arrays grown on nickel foam.
Figure 2C:
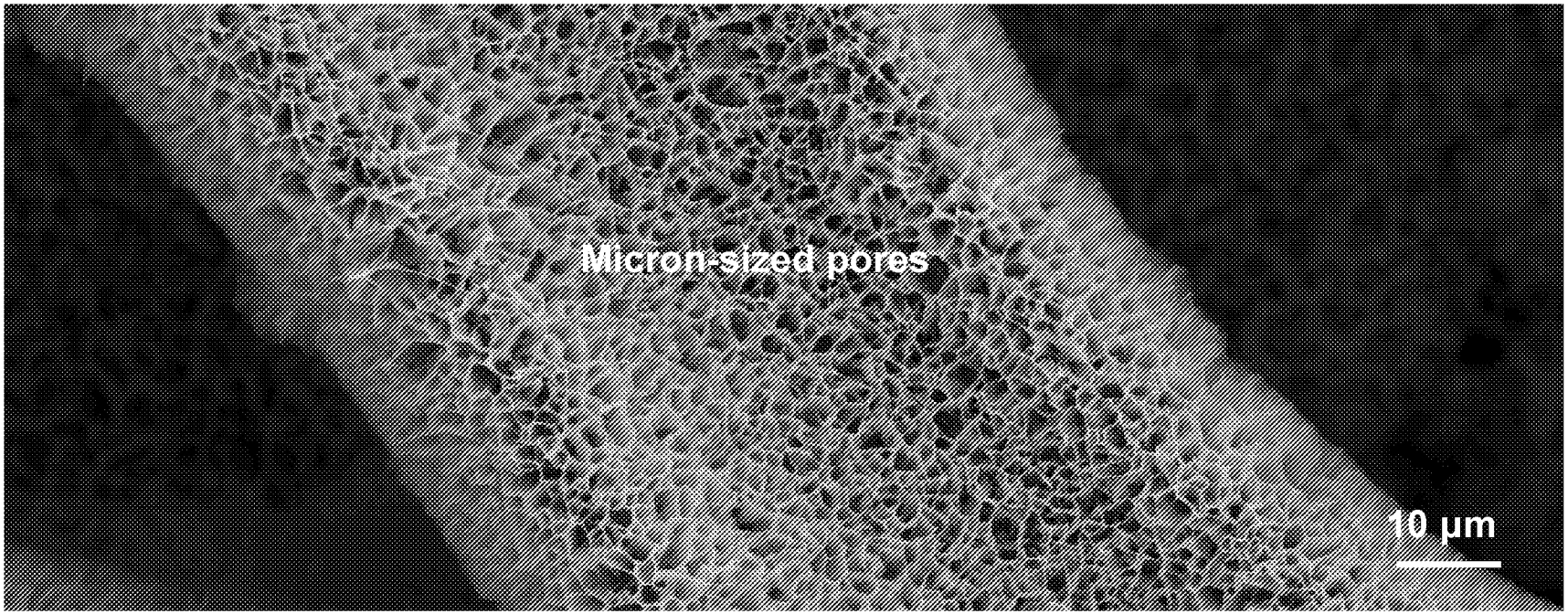
FIG. 2C is an enlarged SEM image of the area in FIG. 2B marked by the dotted box.
Figure 2D:
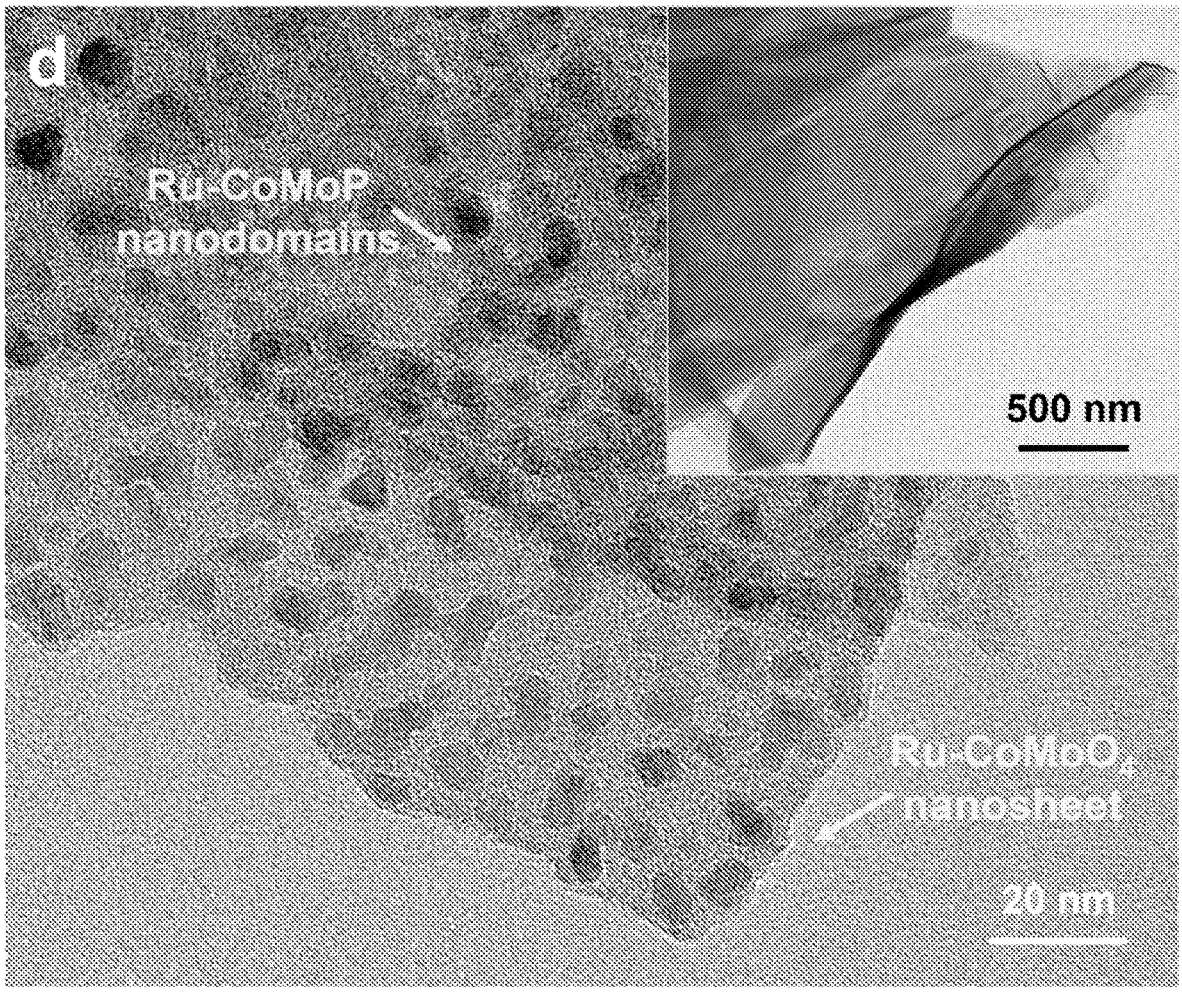
FIG. 2D is a transmission electron microscopy (TEM) image of Ru-CMOP with an inset TEM image of a typical Ru-CMOP nanosheet.
Figure 2E:
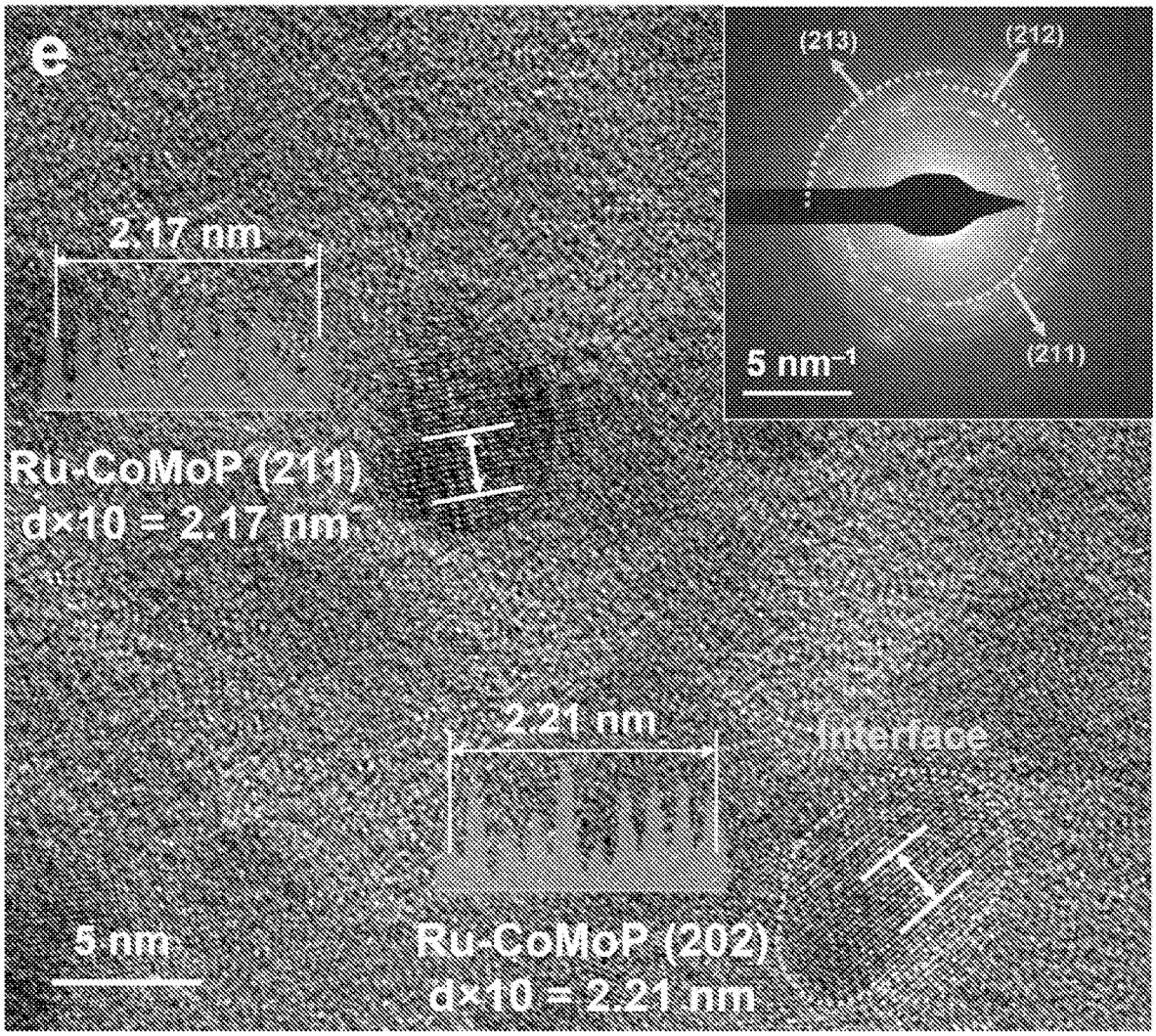
FIG. 2E is a high-resolution transmission electron microscopy (HRTEM) image of Ru-CMOP with insets of selected area electron diffraction (SAED) patterns and facet spacing details.

Scanning electron microscopy (SEM) images of as-obtained Ru-CMOP exhibit a uniform 3D array structure assembled by vertically aligned 2D heterostructure nanosheets on the skeleton of NF (FIG. 2A and FIG. 2B). Abundant spatial voids exist among the interconnected nanosheets, which are well-inherited from the structure of the Ru-CMO precursor (FIG. 2C), contributing to the fast mass transfer and gas release during the electrocatalytic reaction. Observed from transmission electron microscopy (TEM) images of the Ru-CMOP nanosheet, Ru-CMP nanodomains with a dark contrast can be readily distinguished, revealing that they are uniformly dispersed on the Ru-CMO phase with a large number of phase boundaries and distinct heterointerfaces (FIG. 2D). The nanodomains have an average diameter of about 4 to 8 nm, including all ranges, subranges, and values therein, e.g., about 4 nm to about 6 nm, about 6 nm to about 8 nm, about 4 nm to about 5 nm, about 5 nm to about 6 nm, about 6 nm to about 7 nm, about 7 nm to about 8 nm, about 4 nm, about 4.5 nm, about 5 nm, about 5.5, nm, about 6 nm, about 6.5 nm, about 7 nm, about 7.5 nm, about 8 nm, etc., and the thickness of the Ru-CMOP heterostructure is about 10 to 15 nm, including all ranges, subranges, and values therein, e.g., about 10 nm to about 11 nm, about 11 nm to about 12 nm, about 12 nm to about 13 nm, about 13 nm to about 14 nm, about 14 nm to about 15 nm, about 10 nm, about 11 nm, about 12 nm, about 13 nm, about 14 nm, about 15 nm, etc. In FIG. 2E, the high-resolution TEM (HRTEM) image of the nanodomains exhibits the interplanar spacings of 0.217 and 0.221 nm, corresponding to the (211) and (202) planes of Ru-CoMoP crystals. The corresponding selected area electron diffraction (SAED) image illustrates the polycrystalline nature of the phosphatized nanodomains. In this regard, for the controllable phosphorization process, regulated $PH_3$ gas with a low dose derived from the decomposition of $NaH_2PO_2$ attacks the lattice of Ru-CMO precursor at the gas-solid interface. Then, the P atoms partially substitute the lattice O to generate the Ru-CMP nanodomains on the Ru-CMO sheet surface, thereby forming the 2D mosaic heterostructure with rich phase boundaries and heterointerfaces.

Figure 3A:
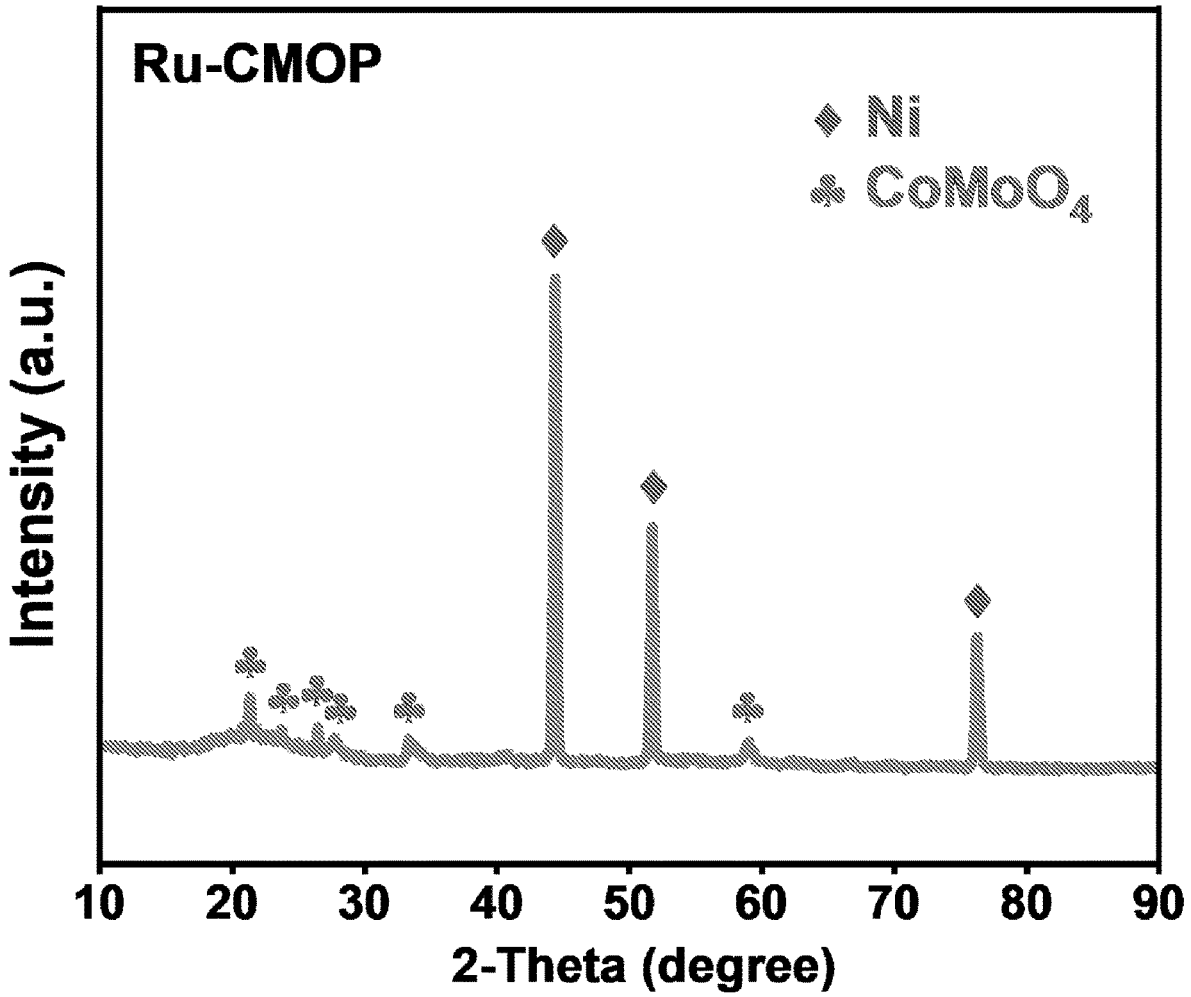
FIG. 3A is an x-ray diffraction (XRD) pattern of Ru-CMOP.
Figure 3B:
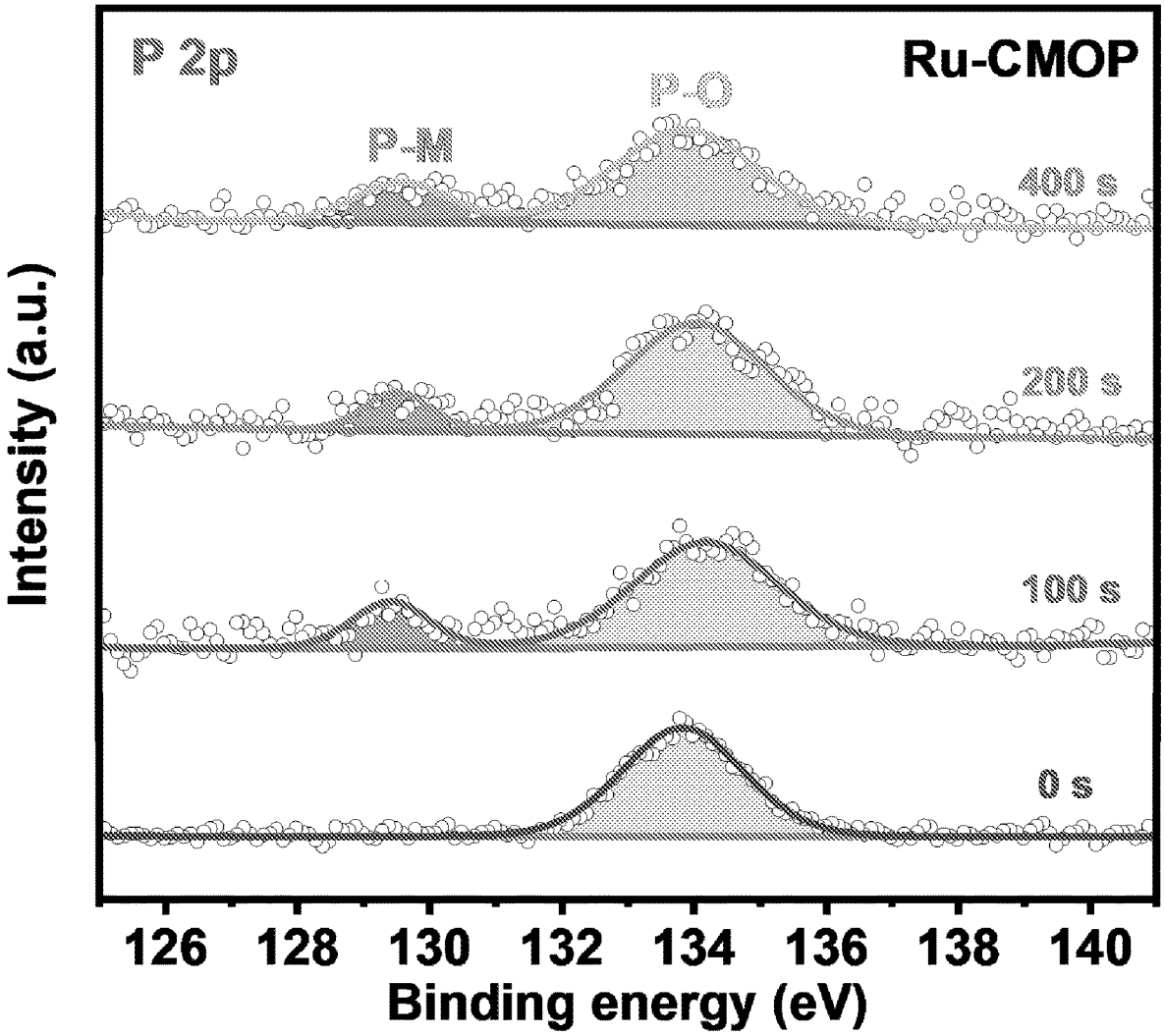
FIG. 3B is a depth-profiling x-ray photoelectron spectroscopy (XPS) spectra of P 2p for Ru-CMOP after Ar ion etching with different duration.
Figure 3C:
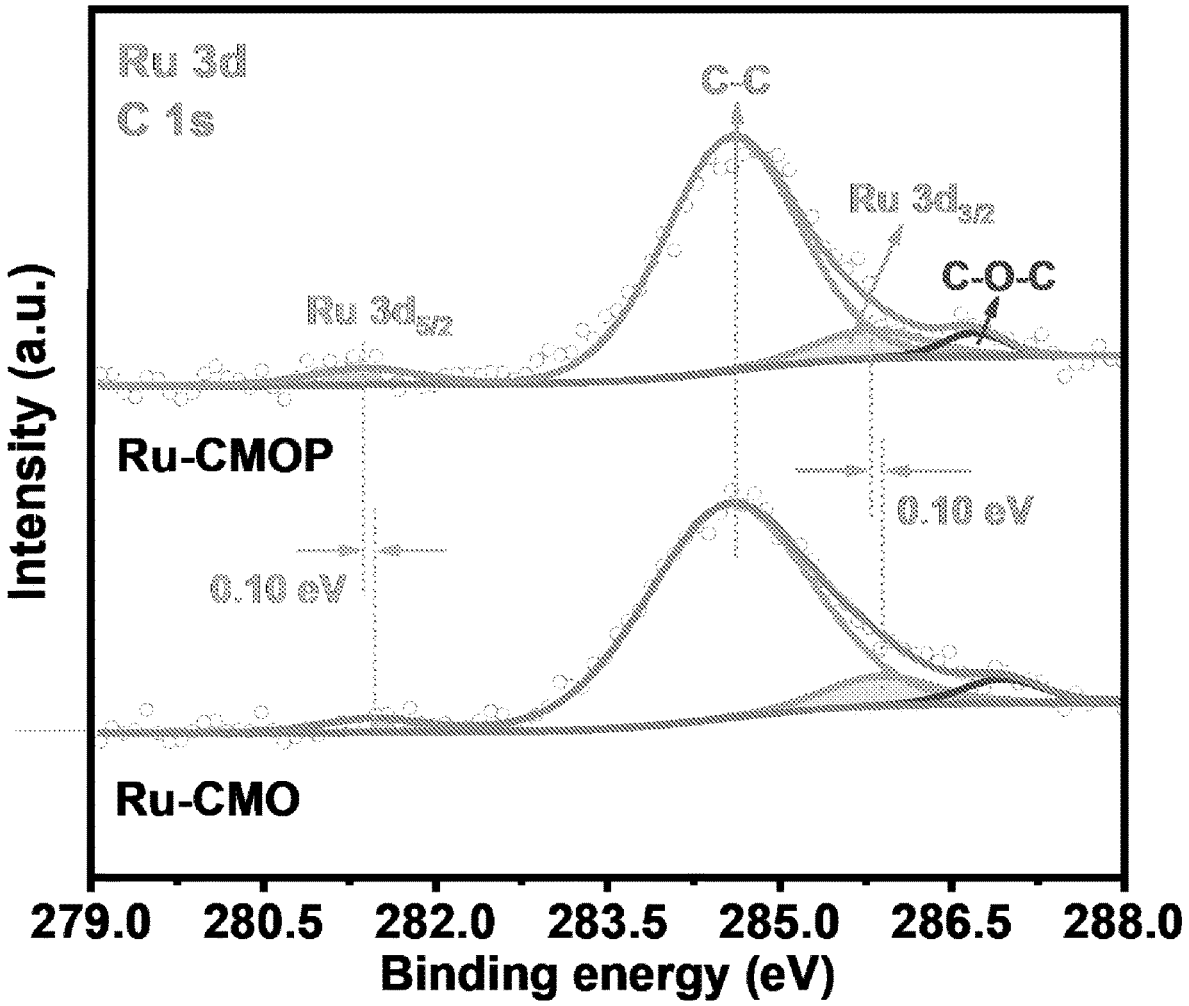
FIG. 3C is a high-resolution XPS for Ru 3d spectra coupled with C 1 s spectra of Ru-CMOP and Ru-CMO.
Figure 3D:
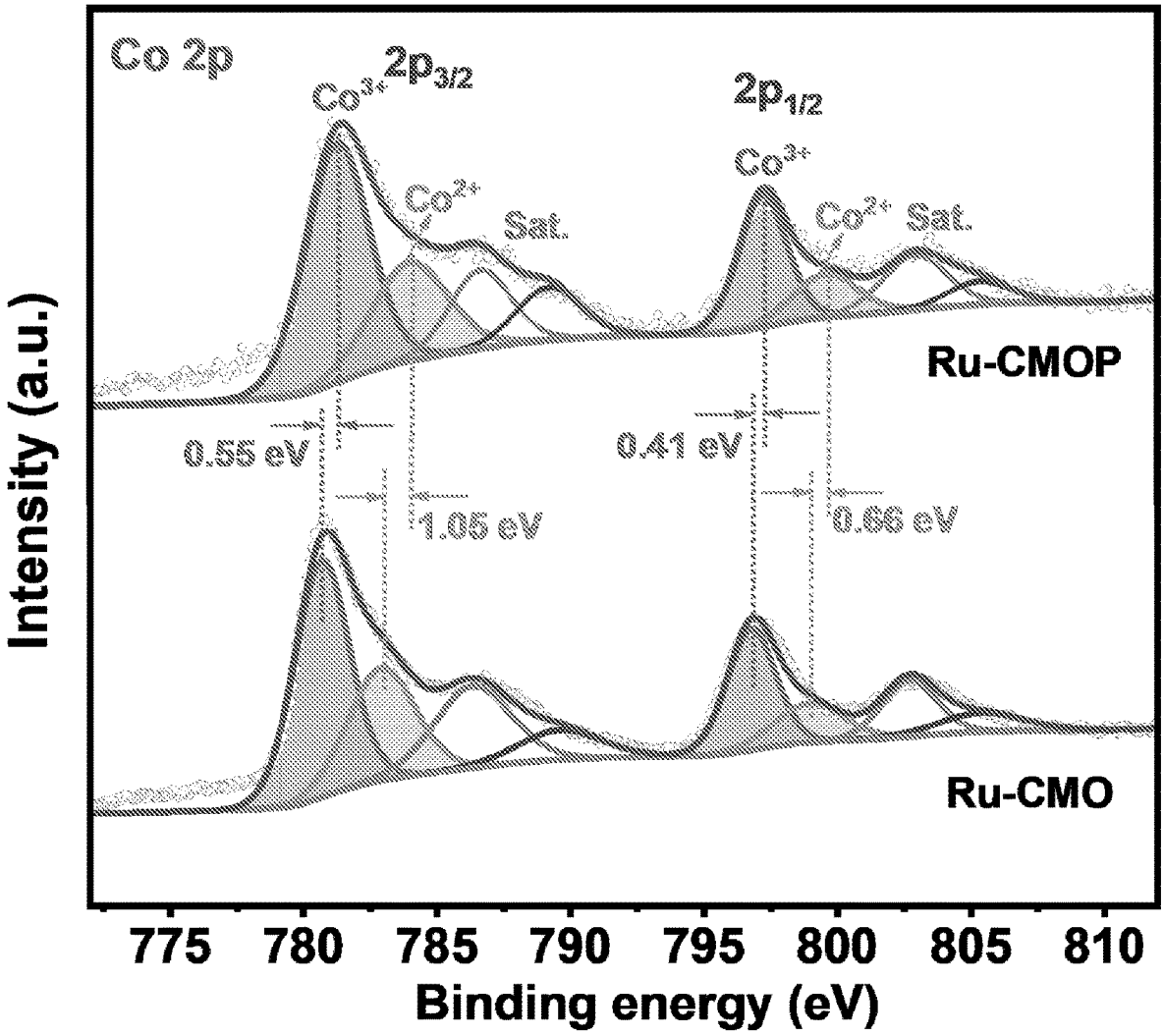
FIG. 3D is a high-resolution XPS for Co 2p spectra of Ru-CMOP and Ru-CMO.

The X-ray diffraction (XRD) result of the Ru-CMOP sample displays the pattern of the $CoMoO_4$ besides the strong peaks of metallic Ni skeleton (FIG. 3A). Notably, there are no peaks ascribed to the ultra-fine Ru-CMP nanodomains, suggesting their good dispersion on the 2D Ru-CMO support, in line with the results of TEM characterizations. For the depth-profiling XPS spectra of P 2p (FIG. 3B), only the P—O peak signal is detected due to the inevitable surface oxidation of metal phosphides resulting from the exposure to air. Then, the P-M (M=Co, Mo, Ru) bond at around 129.5 eV appears after the Ar ion sputtering and remains unchanged as the sputtering duration increases, indicating the Ru-CMP nanodomains embedded in the Ru-CMO nanosheet skeleton. FIG. 3C deconvolutes C 1 s and Ru 3d peaks in Ru-CMOP and Ru-CMO. The detected C 1s peaks originated from the carbon tape used in the XPS test and the contamination with environmental carbon. The binding energies of Ru $3d_{5/2}$ and Ru $3d_{3/2}$ peaks of the Ru-CMOP sample are centered at 281.38 and 285.78 eV, respectively, which is a slight shift towards lower binding energies as compared to those of Ru-CMO (Ru $3d_{5/2}$/Ru $3d_{3/2}$: 281.48 cV/285.88 cV). The high-resolution Co 2p spectra of the two samples can be deconvoluted into two spin-orbit doublets and two shakeup satellites (denoted as "Sat.") (FIG. 3D). For the Ru-CMOP, the first doublet at 781.24 and 783.96 eV and the second at 797.18 and 799.58 eV are attributed to Co $2p_{3/2}$ and Co $2p_{1/2}$, respectively. It is observed that the phosphorization treatment leads to an upshift behavior of the Co 2p spectra for Ru-CMOP as compared to those of Ru-CMO. Moreover, the Mo 3d and O 1 s peaks also exhibit positive shifts as compared to the Ru-CMO precursor. These results signify the charge redistribution occurs after the formation of Ru-CMP nanodomains due to the strong interfacial interaction.

Figure 3E:
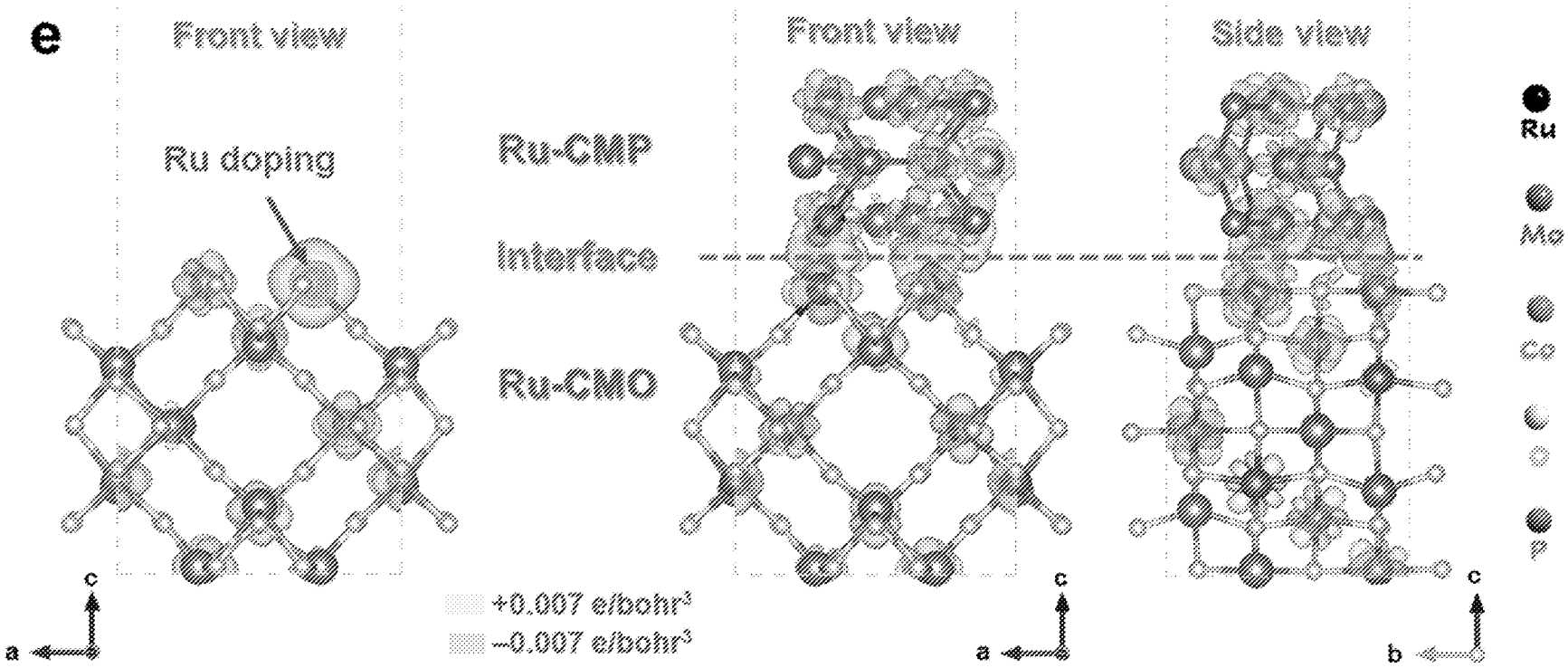
FIG. 3E is a differential charge density of Ru-CMO an Ru-CMOP, where the contours represent electron accumulation ($\Delta\rho$=+0.007e×bohr$^{-3}$) and depletion ($\Delta\rho$=+0.007e×bohr$^{-3}$)

To further illustrate this, the differential charge density is calculated to identify the charge distribution on the Ru-CMO and Ru-CMOP (FIG. 3E). For the Ru-CMO, an accumulation charge density can be visualized around the Ru doping atoms in the CMO lattice. After the addition of Ru-CMP on Ru-CMO, a charge accumulation is observed at the interface between Ru-CMO and Ru-CMP, indicating the formation of a built-in electric field near the heterointerface, which establishes the highway of continuous electron transport between the two phases. Those results demonstrate that the Ru doping and Ru-CMP assembling could induce the redistribution of the electronic structure, which results in the enhanced electron circumstances for catalyzing the electrocatalytic reaction.

According to an aspect of the present disclosure, there is provided a catalyst including a support, a plurality of Ru-doped $CoMoO_4$ nanosheet arrays (Ru-CMO) assembled on the support; and a plurality of phosphide nanodomains (Ru-CMP) on the Ru-doped $CoMoO_4$ nanosheet arrays. In an example, the support may be a nickel foam or a carbon fiber paper. In another example, the phosphide nanodomains may have an average diameter of about 4 to 8 nm, including all ranges, subranges, and values therein, e.g., about 4 nm to about 6 nm, about 6 nm to about 8 nm, about 4 nm to about 5 nm, about 5 nm to about 6 nm, about 6 nm to about 7 nm, about 7 nm to about 8 nm, about 4 nm, about 4.5 nm, about 5 nm, about 5.5 nm, about 6 nm, about 6.5 nm, about 7 nm, about 7.5 nm, about 8 nm, etc. In yet another example, the thickness of the Ru-CMOP heterostructure is about 10 to 15 nm, including all ranges, subranges, and values therein, e.g., about 10 nm to about 11 nm, about 11 nm to about 12 nm, about 12 nm to about 13 nm, about 13 nm to about 14 nm, about 14 nm to about 15 nm, about 10 nm, about 11 nm, about 12 nm, about 13 nm, about 14 nm, about 15 nm, etc. In an example, the catalyst is made by the method described hereinabove.

HER and OER Performance in Alkaline Media

Figure 4A:
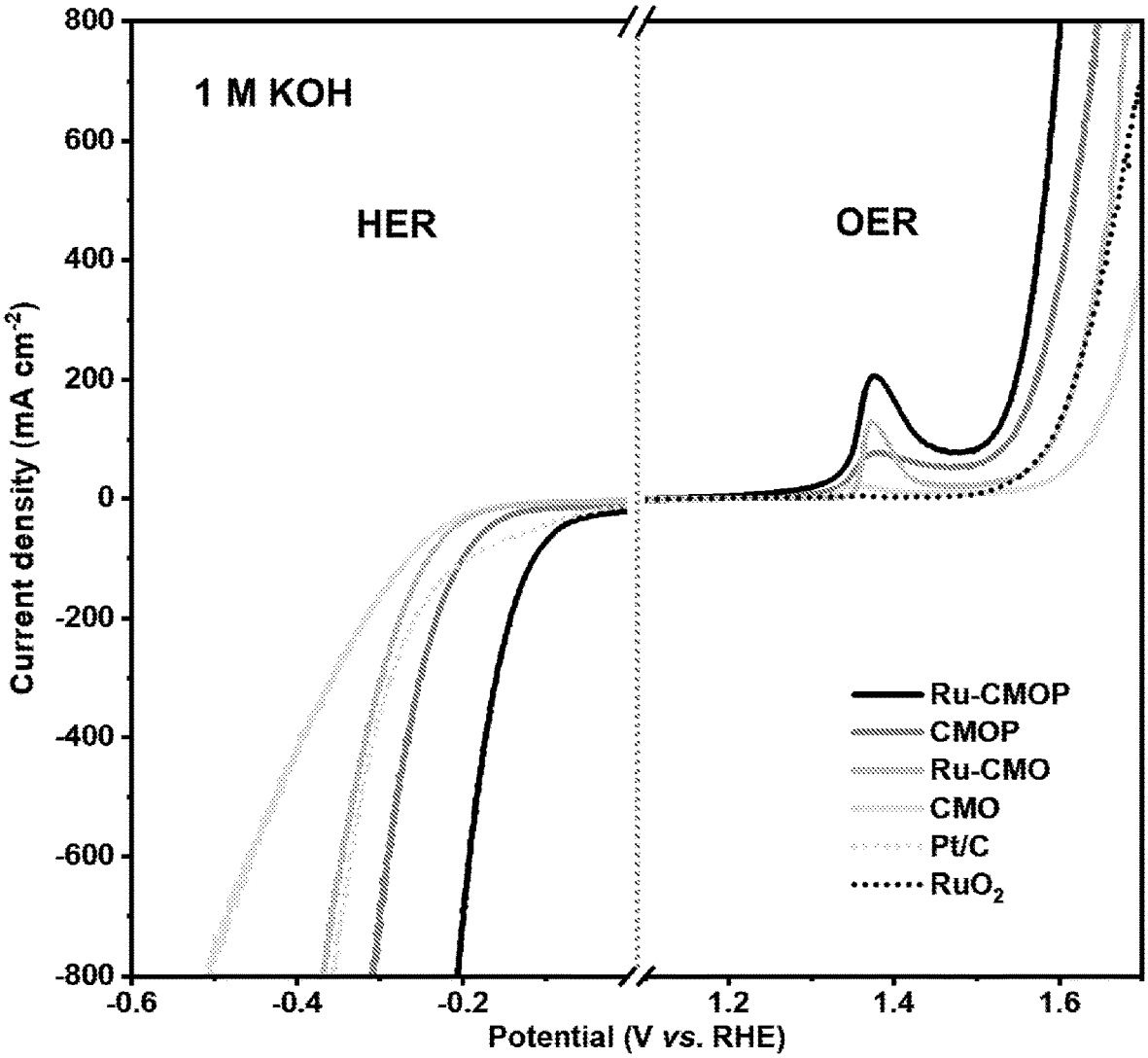
FIG. 4A depicts polarization curves for hydrogen evolution reaction (HER) and oxygen evolution reaction (OER) in 1 M KOH solution.
Figure 4B:
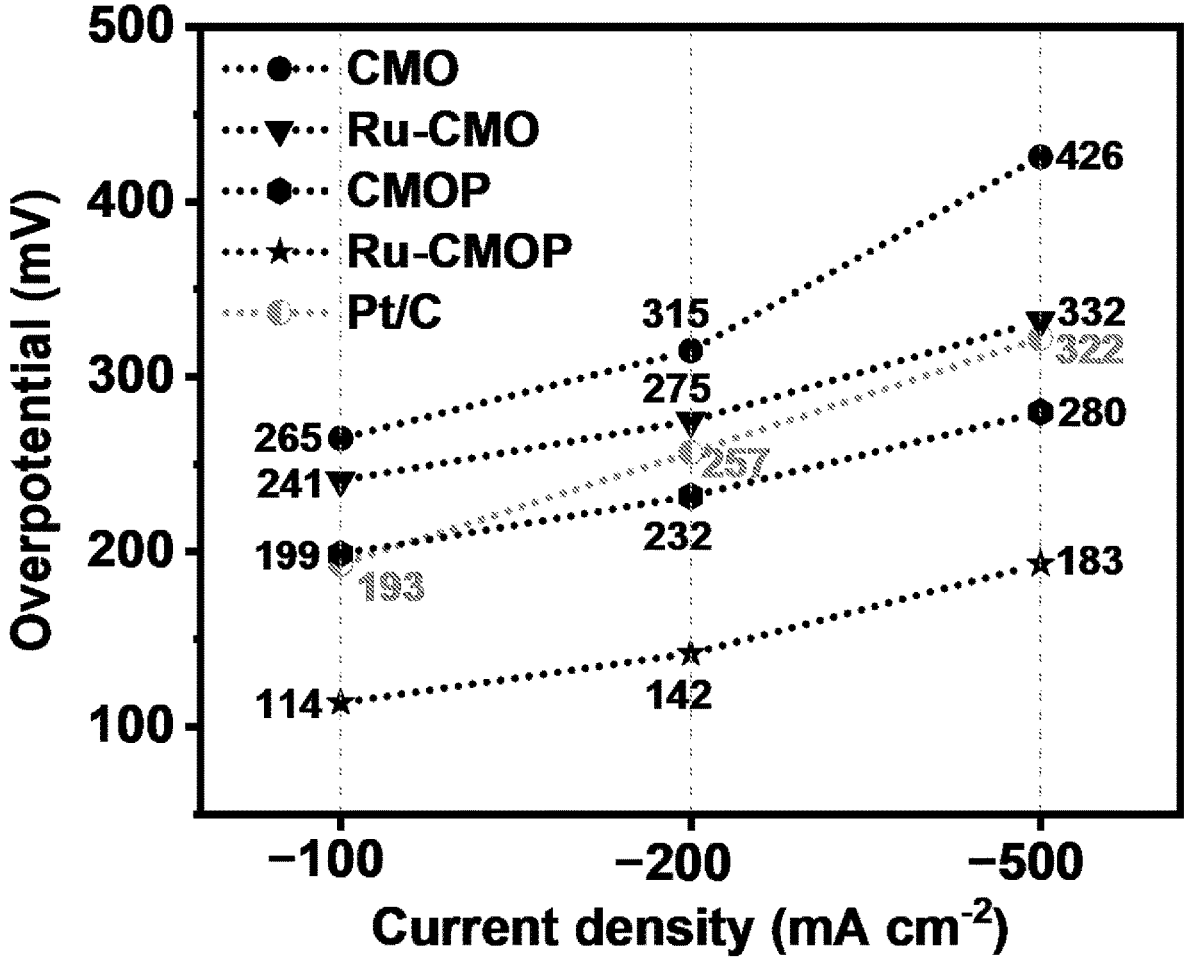
FIG. 4B is a graph of the overpotentials of CMO, Ru-CMO, CMOP, Ru-CMOP, and Pt/C at different current densities for HER performance.
Figure 4C:
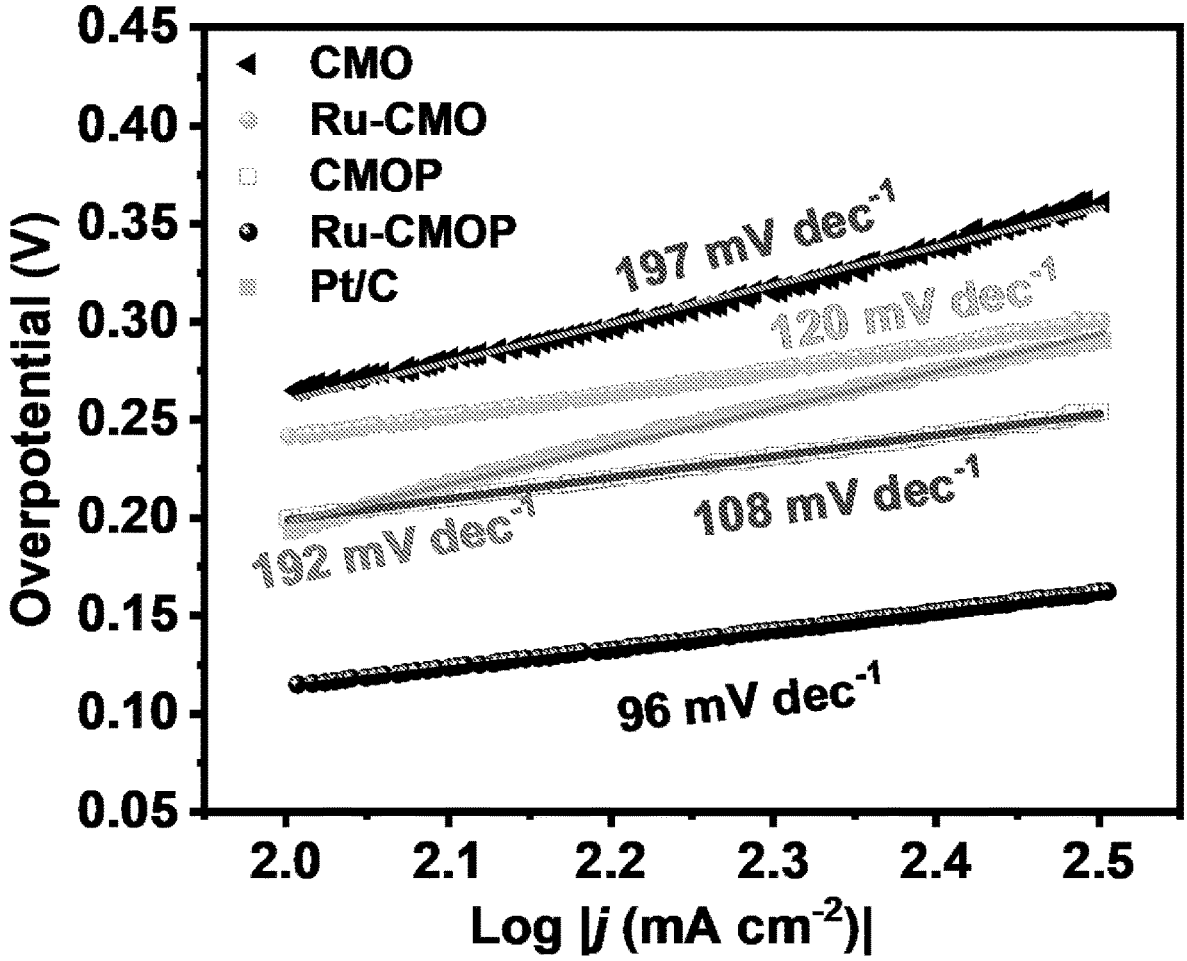
FIG. 4C is a Tafel plot for HER performance of the examples in FIG. 4B.

The HER performance of the as-obtained Ru-CMOP is evaluated in an Ar-saturated 1.0 M KOH aqueous solution with a typical three-electrode system. Samples of Ru-CMO, CMOP, and CMO as counterparts and Pt/C as a benchmark are measured under identical conditions for comparison. The polarization curves of the tested catalysts for HER are presented in FIG. 4A. As a result, the Ru-CMOP exhibits significantly superior HER performance than the comparative samples, especially in high current density. Specifically, in comparison of CMOP (199, 232, and 280 mV), Ru-CMO (241, 275, and 332 mV), CMO (265, 315, and 426 mV), and Pt/C (193, 257, and 322 mV), Ru-CMOP delivers the current densities of 100, 200, and 500 mA $cm^{-2}$ at the low overpotentials of 114, 142 and 183 mV, respectively (FIG. 4B). As shown in FIG. 4C, the Tafel slope of Ru-CMOP exhibits the lowest value of 96 mV $dec^{-1}$ as compared with those of CMOP (108 mV $dec^{-1}$), Ru-CMO (120 mV $dec^{-1}$), CMO (197 mV $dec^{-1}$), and Pt/C (192 mV $dec^{-1}$), indicating the rapid kinetics of Ru-CMOP owing to the introduction of Ru dopant and the generation of ultrafine Ru-CMP nanodomains.

Afterward, the stability of Ru-CMOP for HER activity is evaluated via a chronopotentiometry (CP) curve at −250 mA $cm^{-2}$ for 60 h. As displayed in FIG. 4F, there is no large potential change in this strong reducing environment for a long duration. The morphology of post-Ru-CMOP subjected to the HER stability test is well-sustained in the nanosheet-array structure, suggesting the structural stability of the 3D architecture assembled from the 2D heterostructure nanosheets.

Figure 4D:
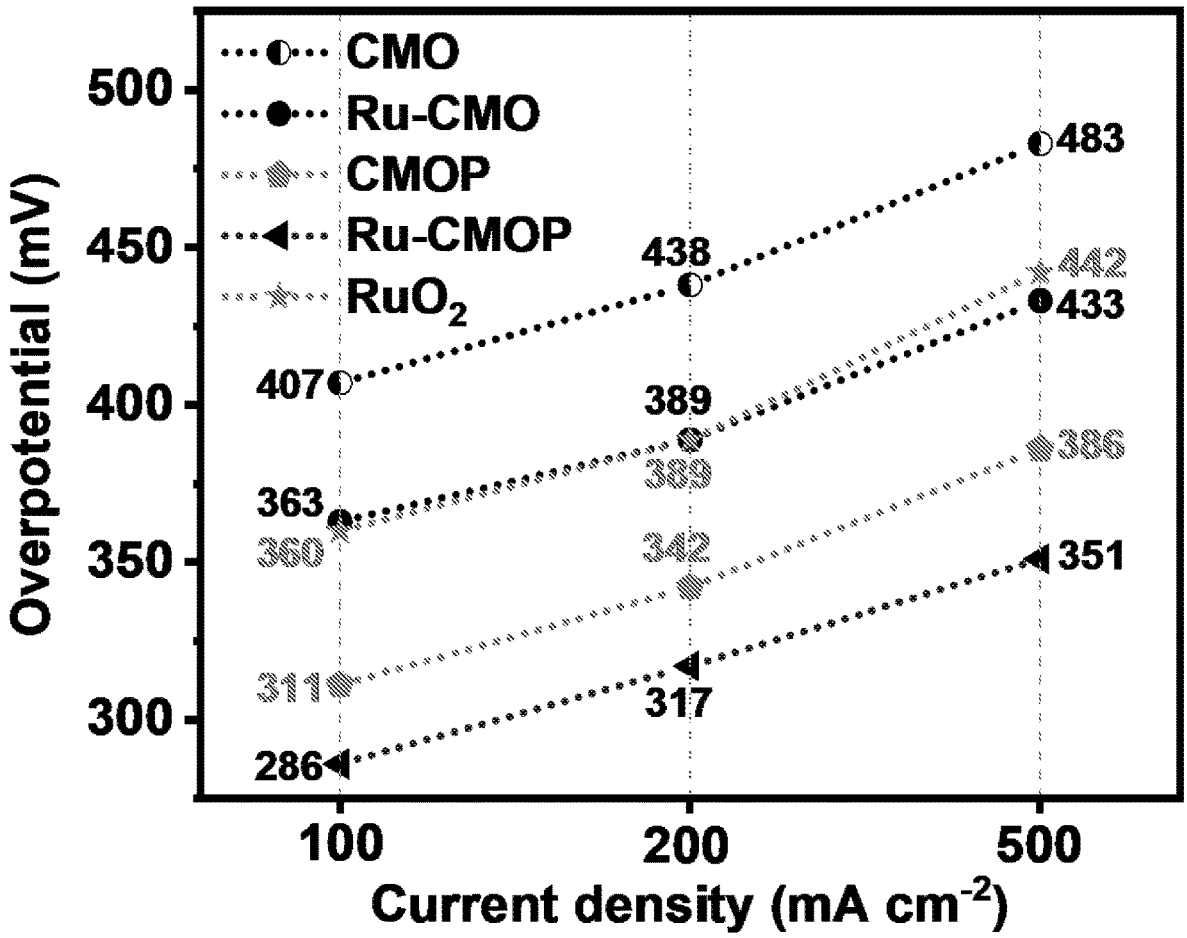
FIG. 4D is a graph of the overpotentials of CMO, Ru-CMO, CMOP, Ru-CMOP, and Pt/C at different current densities for OER performance.
Figure 4E:
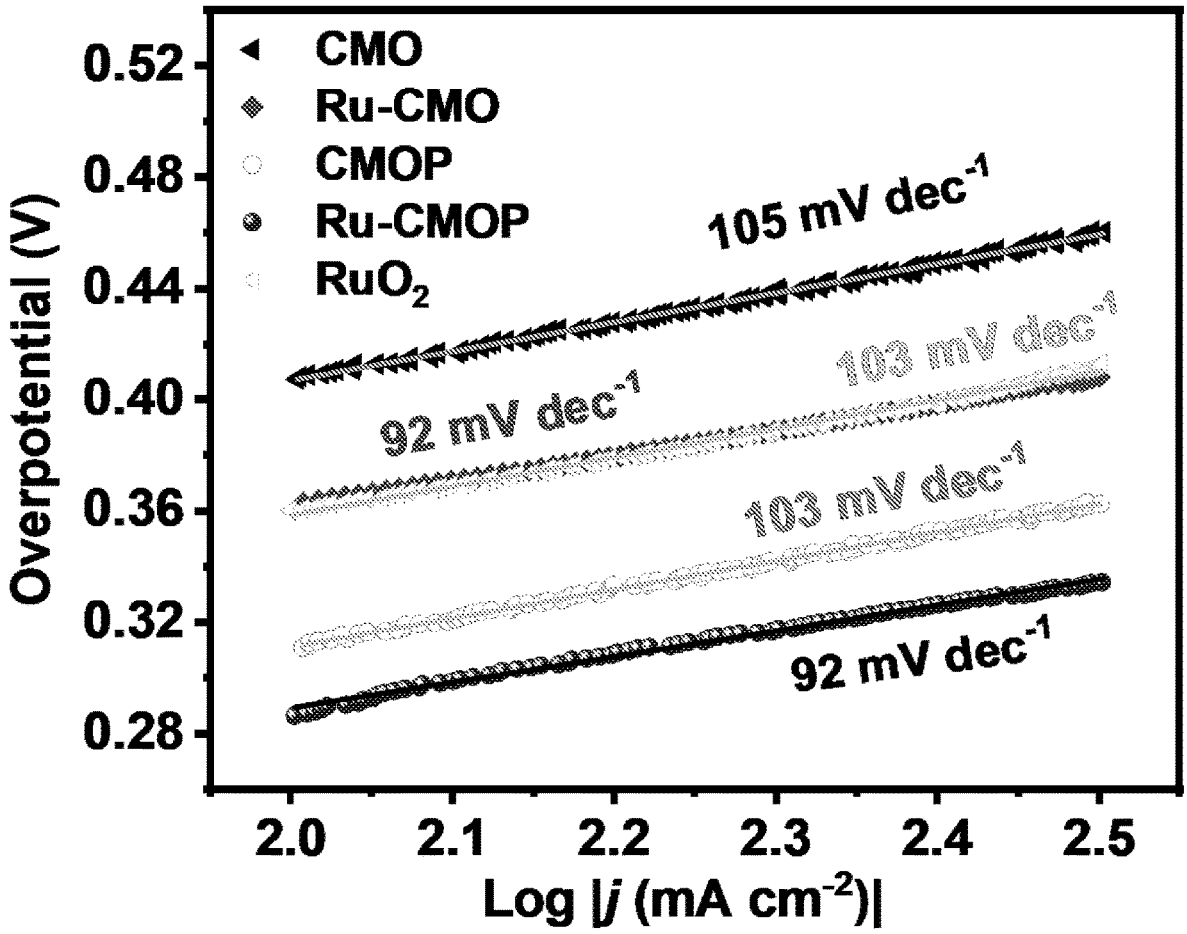
FIG. 4E is a Tafel plot for HER performance of the examples in FIG. 4D.

In the following, the OER performance of the catalysts is investigated in the Ar-saturated 1.0 M KOH solution via the three-electrode system. The commercial $RuO_2$ is applied as a benchmark sample. As shown in FIG. 4A, the polarization curves of the tested catalysts indicate the Ru-CMOP possesses the best catalytic activity toward the OER. In the comparison of CMOP (311, 342, and 386 mV), Ru-CMO (363, 389, and 433 mV), CMO (407, 438, and 483 mV), and $RuO_2$ (360, 389, and 442 mV), Ru-CMOP delivers the current densities of 100, 200, and 500 mA $cm^{-2}$ at the low overpotentials of 286, 317 and 351 mV, respectively (FIG. 4D). In FIG. 4E, the Tafel slope of the Ru-CMOP is calculated to be 92 mV $dec^{-1}$, which is equal to that of Ru-CMO (92 mV $dec^{-1}$) and lower than those of CMOP (103 mV $dec^{-1}$), CMO (103 mV $dec^{-1}$), and $RuO_2$ (105 mV $dec^{-1}$). This result demonstrates that the Ru doping contributes to the favorable kinetics for OER.

Figure 4F:
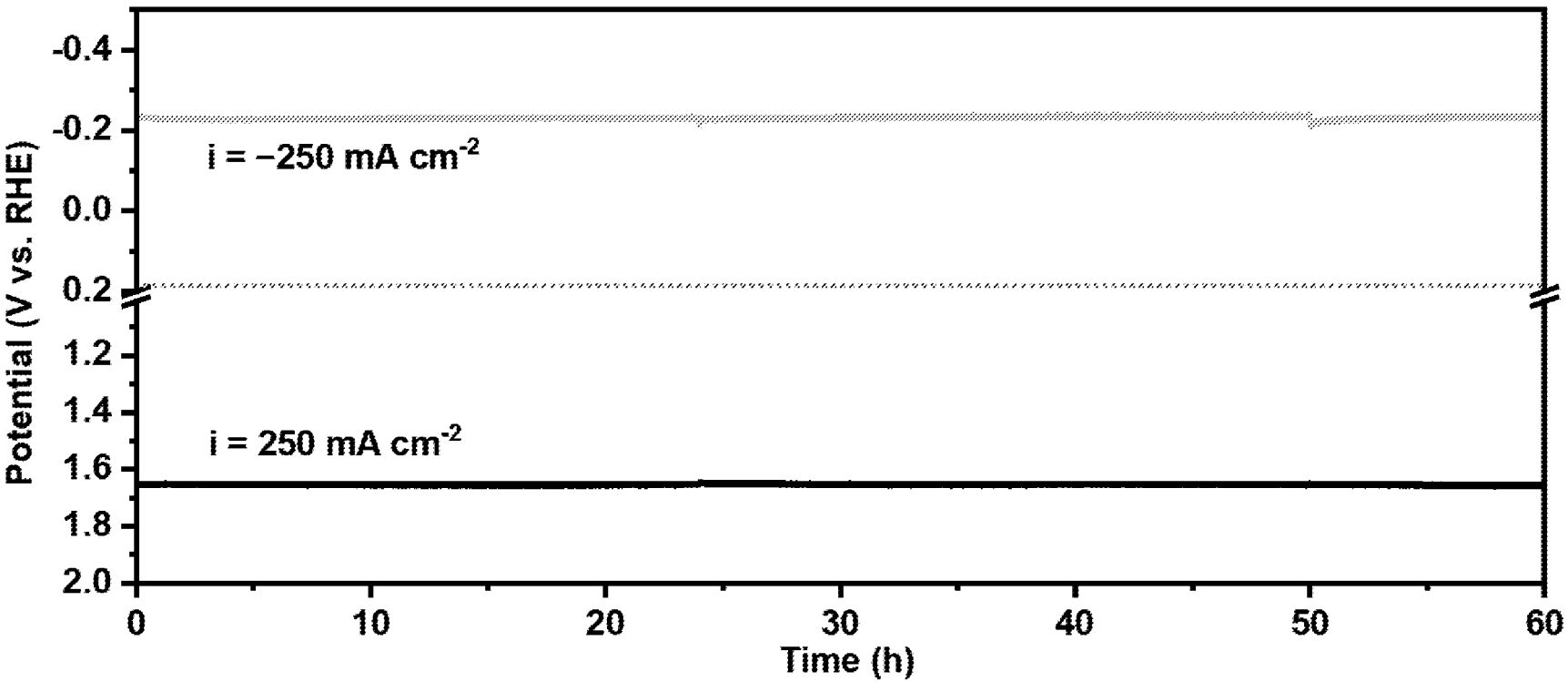
FIG. 4F depicts chronopotentiometry (CP) curves of Ru-CMOP without iR correction at −250 mA cm$^{-2}$ and 250 mA cm$^{-2}$.
Figure 4G:
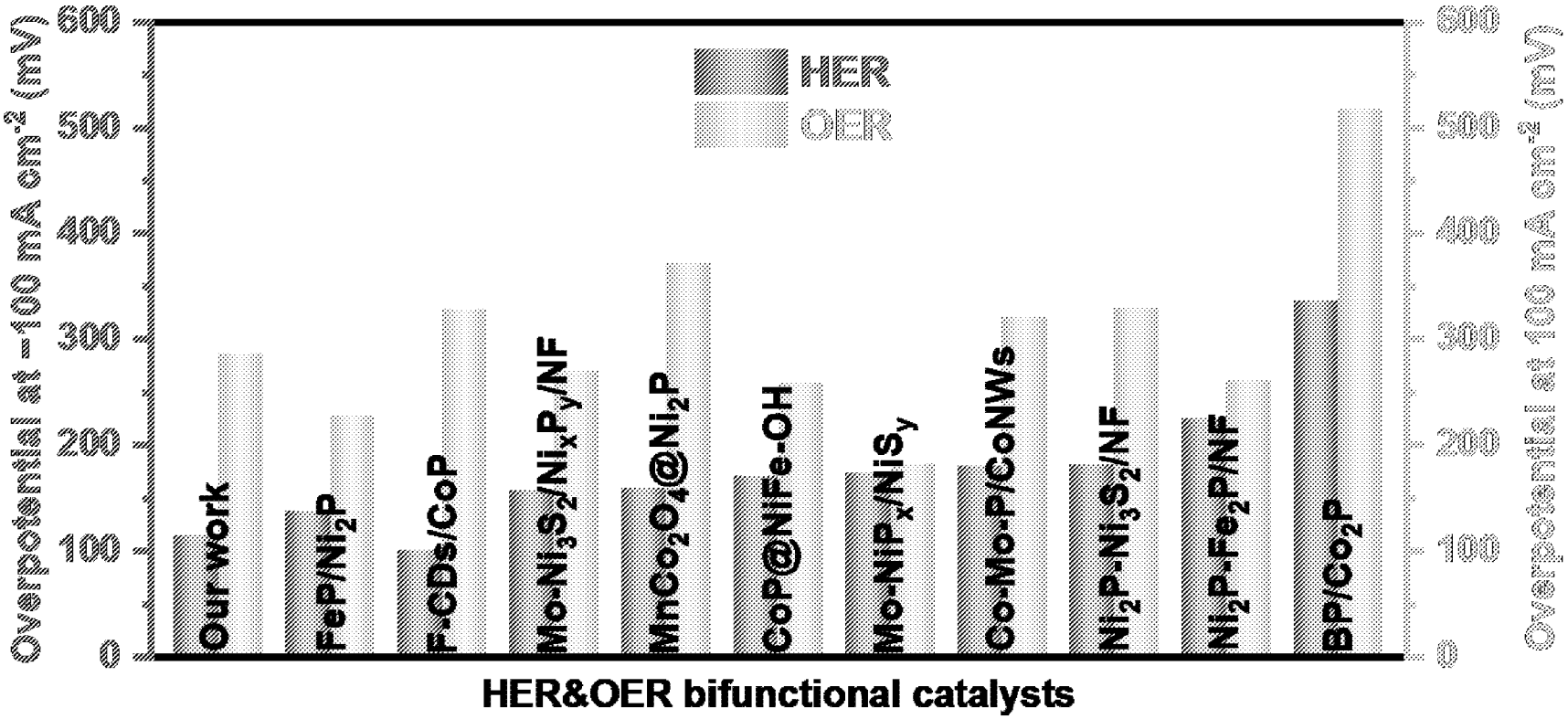
FIG. 4G is a graph comparing overpotentials at −100/100 mA cm$^{-2}$ with the reported phosphide-based bifunctional heterostructures.

Moreover, the Ru-CMOP shows decent stability at 250 mA $cm^{-2}$ for 60 h without any noticeable degradation in the alkaline media (FIG. 4F). Additionally, as shown in FIG. 4G, the electrocatalytic activity of Ru-CMOP for both HER and OER in alkaline solution outperforms most of the reported phosphide-based bifunctional heterostructures, suggesting that Ru-CMOP is a promising candidate for overall water splitting.

Overall Water Splitting Application

Figure 5A:
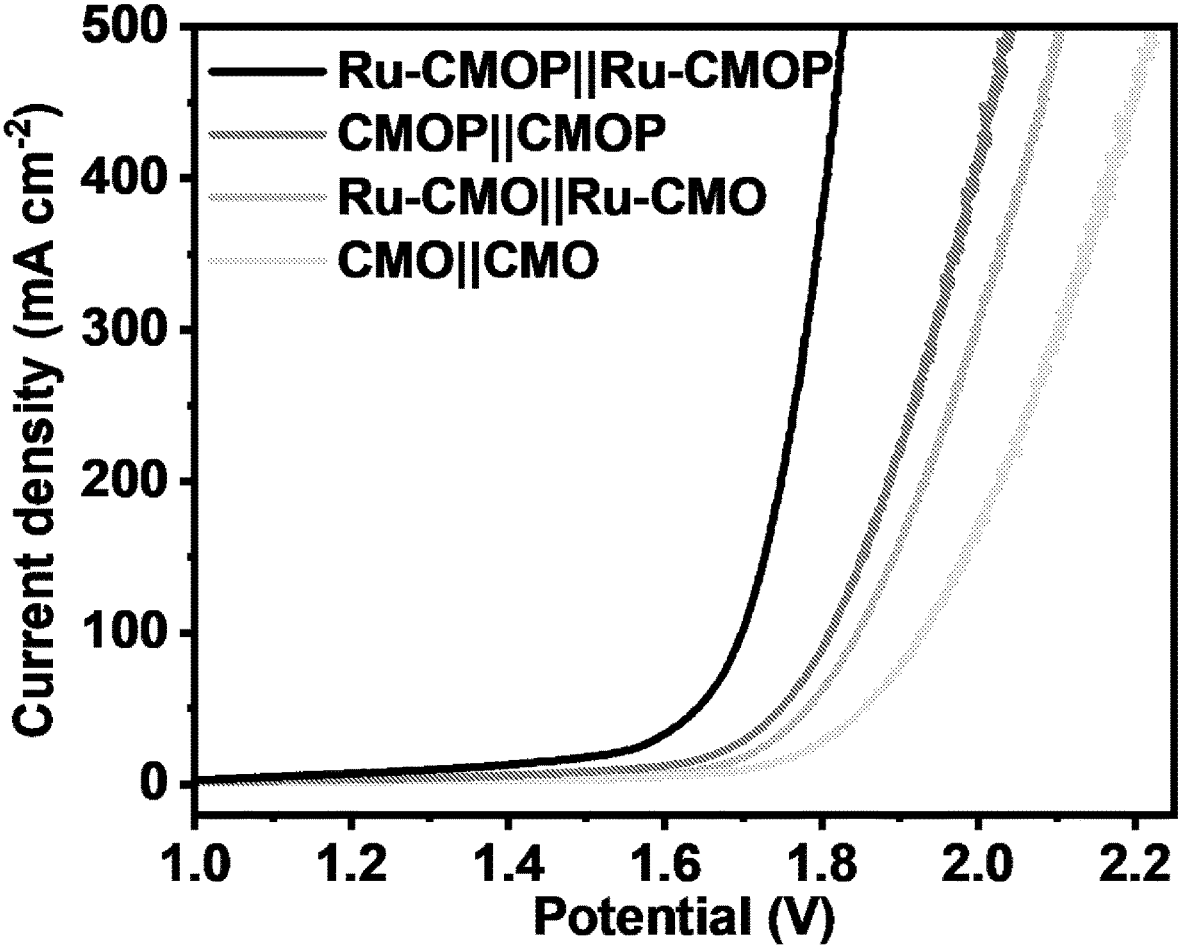
FIG. 5A is a graph of polarization curves conducted on a two-electrode configuration for overall water splitting in 1.0 M KOH.
Figure 5B:
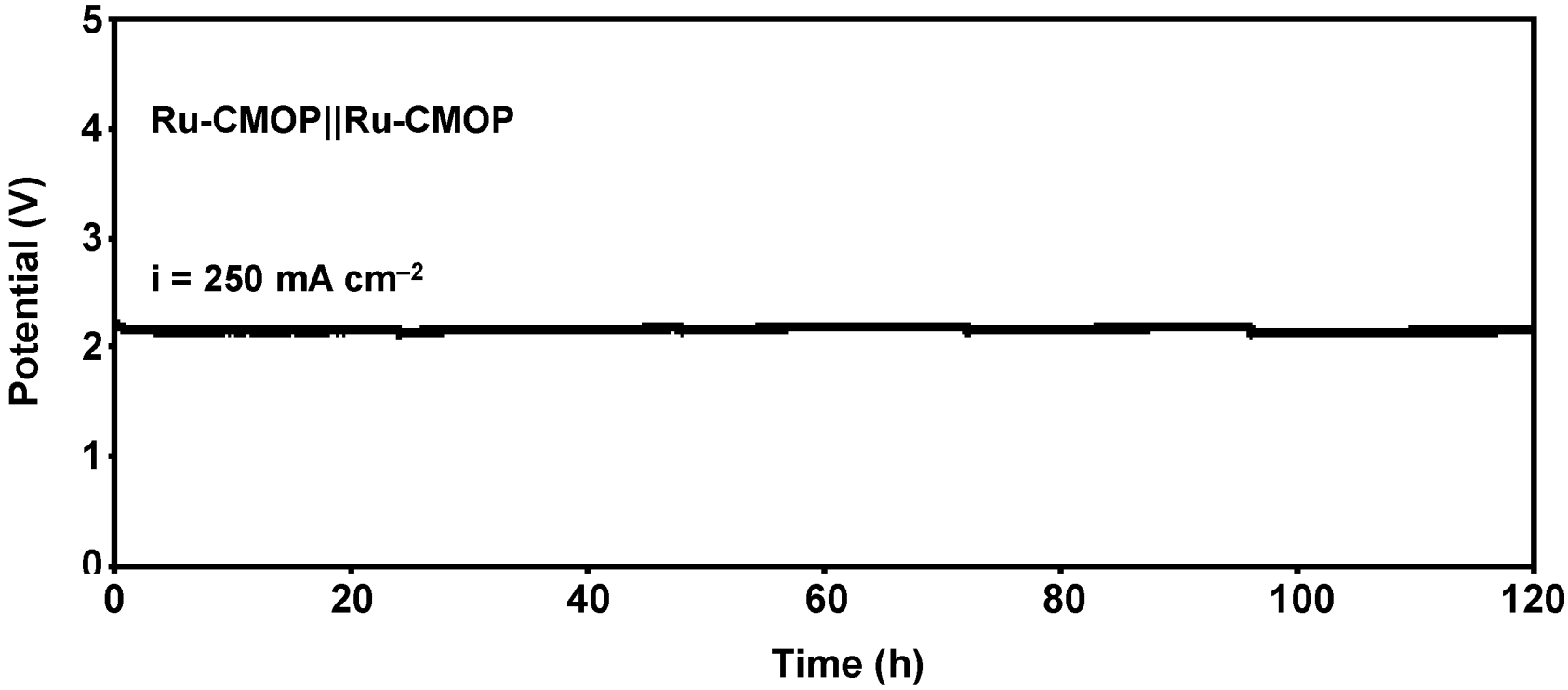
FIG. 5B is a potential comparison of different current densities for overall water splitting.
Figure 5C:
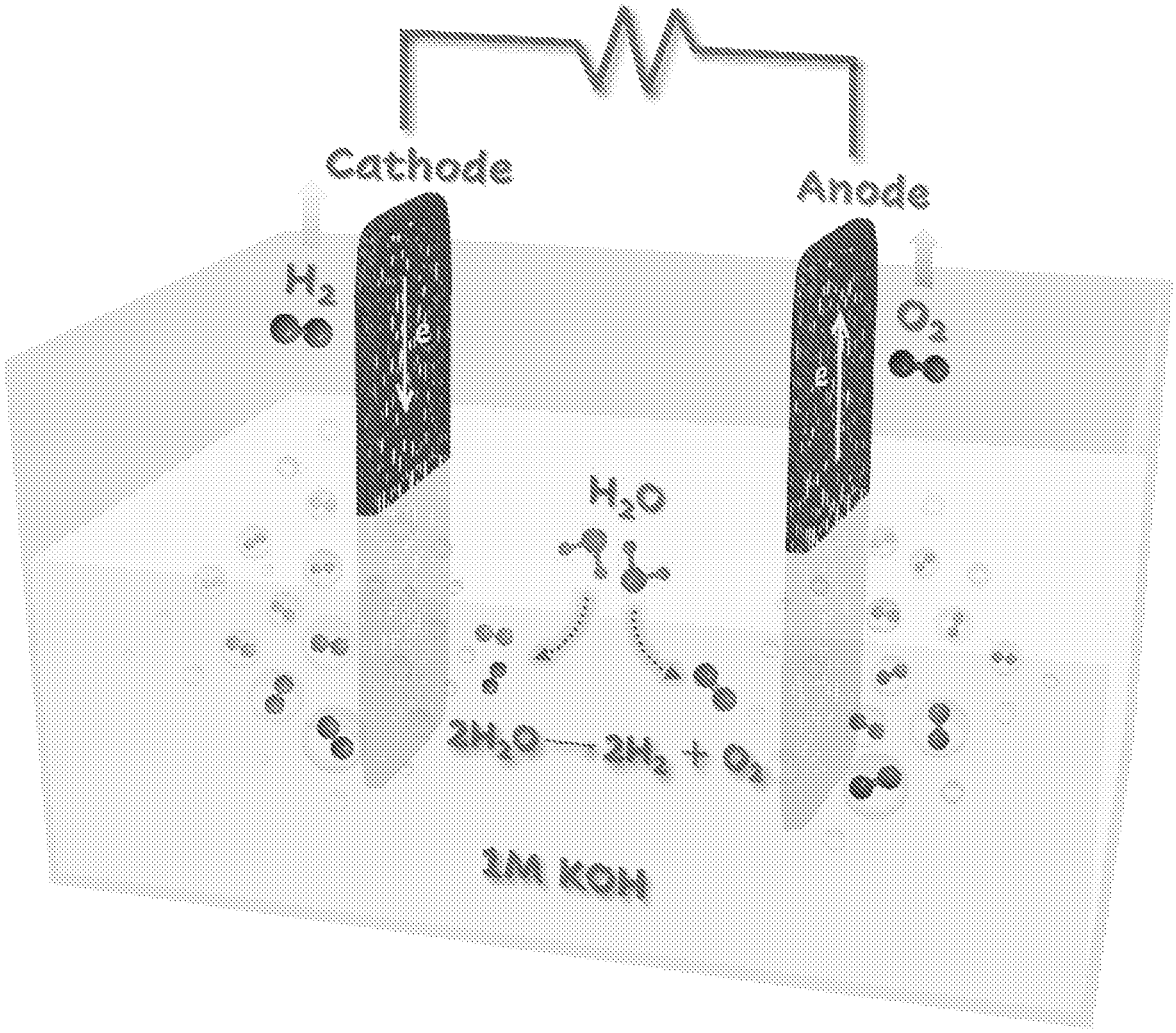
FIG. 5C is a CP curve of Ru-CMOP||Ru-CMOP couple without iR correction at 250 mV cm$^{-2}$.

A two-electrode configuration using Ru-CMOP as both anode and cathode is built for overall water splitting in 1.0 M KOH electrolyte, which is denoted as Ru-CMOP||Ru-CMOP. Similarly, the CMOP||CMOP, Ru-CMO||Ru-CMO, and CMO||CMO two-electrode configurations are also constructed for comparison. As shown in FIG. 5A, the Ru-CMOP||Ru-CMOP exhibits the smallest cell voltage of 1.697 V to reach a current density of 100 mA $cm^{-2}$ superior to those of the CMOP||CMOP (1.809 V), Ru-CMO||Ru-CMO (1.846 V), and CMO||CMO (1.929 V). Notably, the Ru-CMOP||Ru-CMOP delivers high current densities of 200 and 500 mA $cm^{-2}$ achieved by a cell voltage of 1.748 and 1.828 V, respectively (FIG. 5B). Furthermore, the durability of this Ru-CMOP||Ru-CMOP electrolyzer is examined at a high current density of 250 mA $cm^{-2}$. As a result, the CP curve illustrates that the Ru-CMOP||Ru-CMOP couple maintains a steady cell voltage at 250 mA $cm^{-2}$ for 120 h (FIG. 5C), manifesting the robustness of Ru-CMOP for overall water splitting.

Figure 5D:
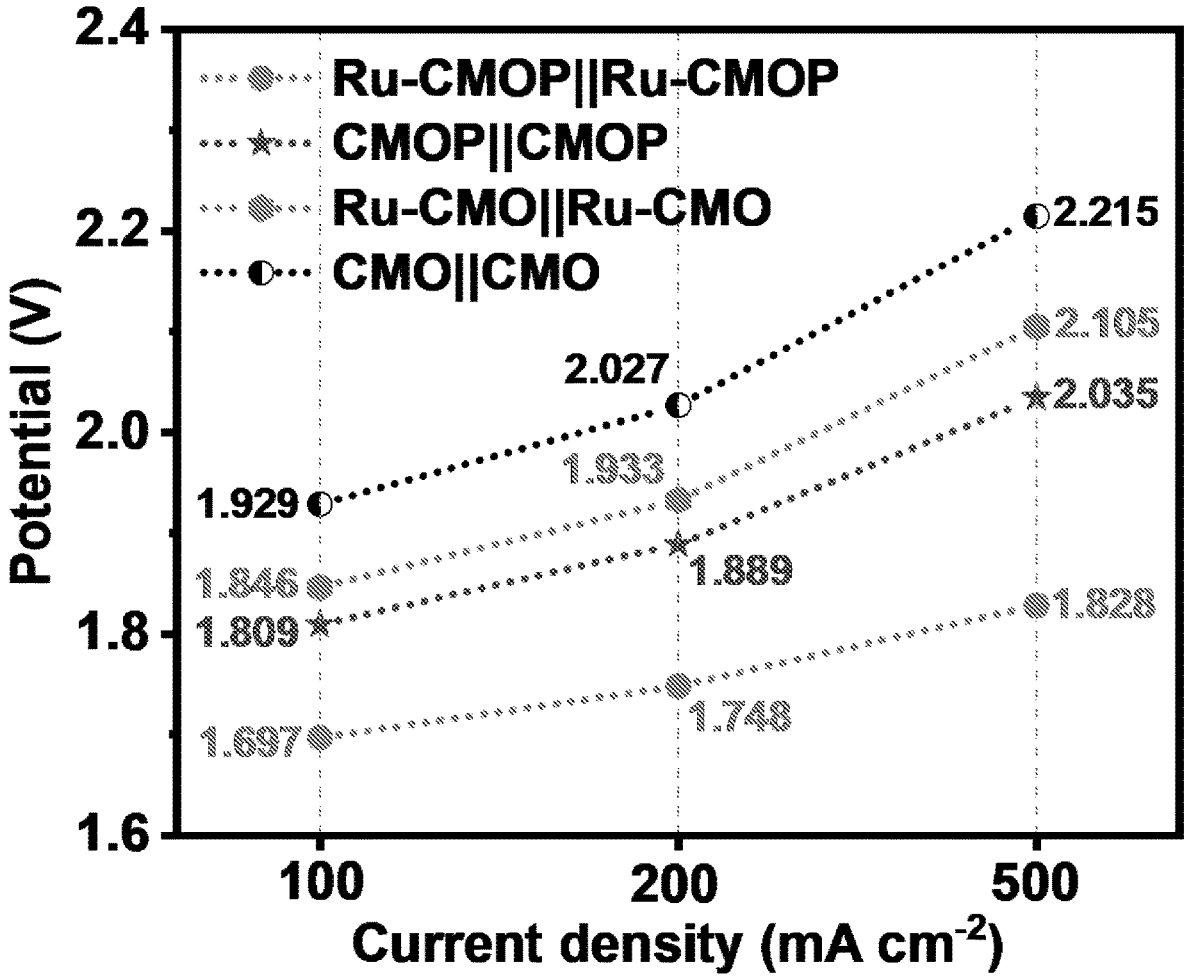
FIG. 5D is a schematic illustration of Ru-CMOP nanosheet for overall water splitting.
Figure 5E:
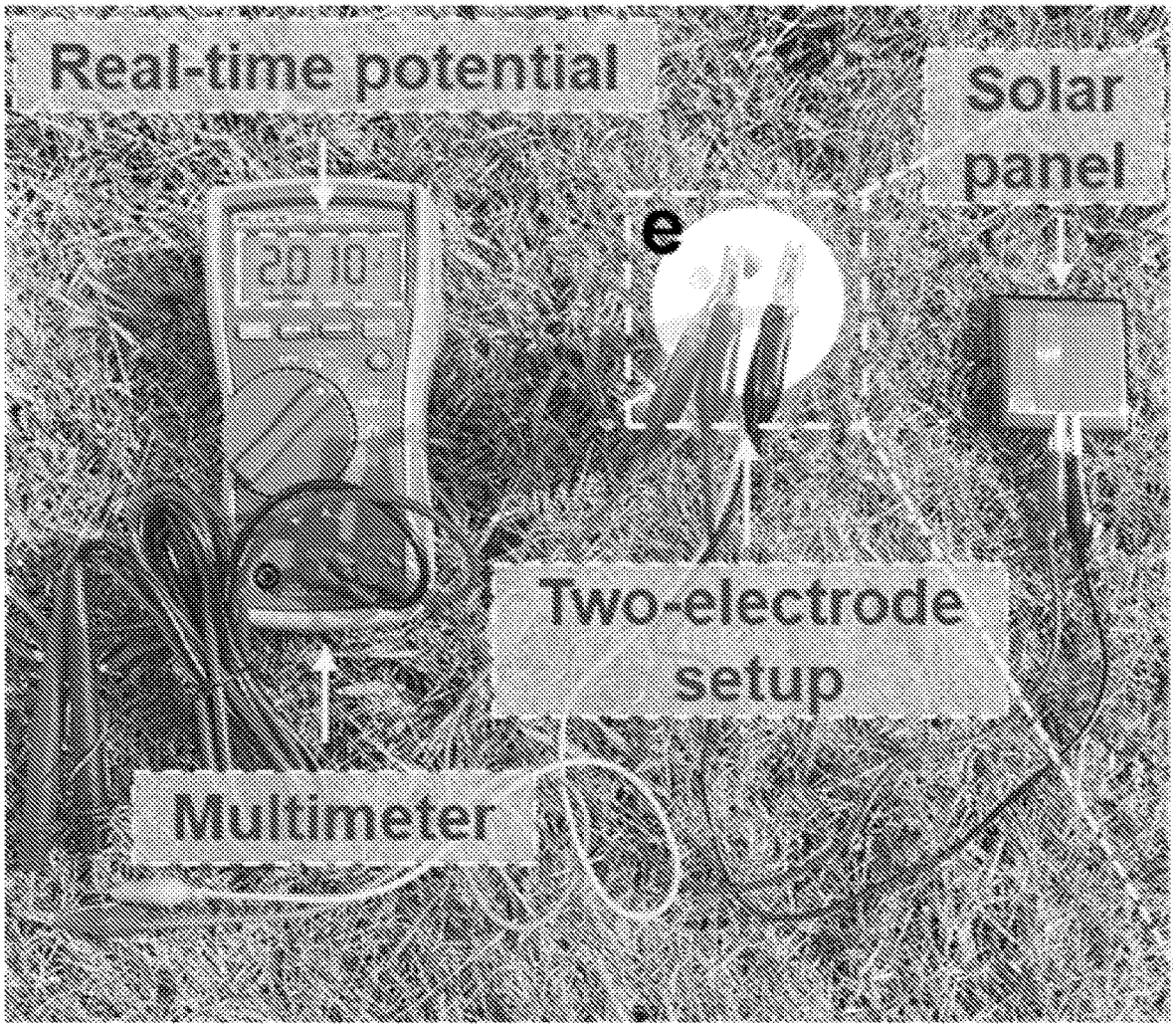
FIG. 5E is a digital photograph of an electrolyzer driven by a silicon solar cell.
Figure 5F:
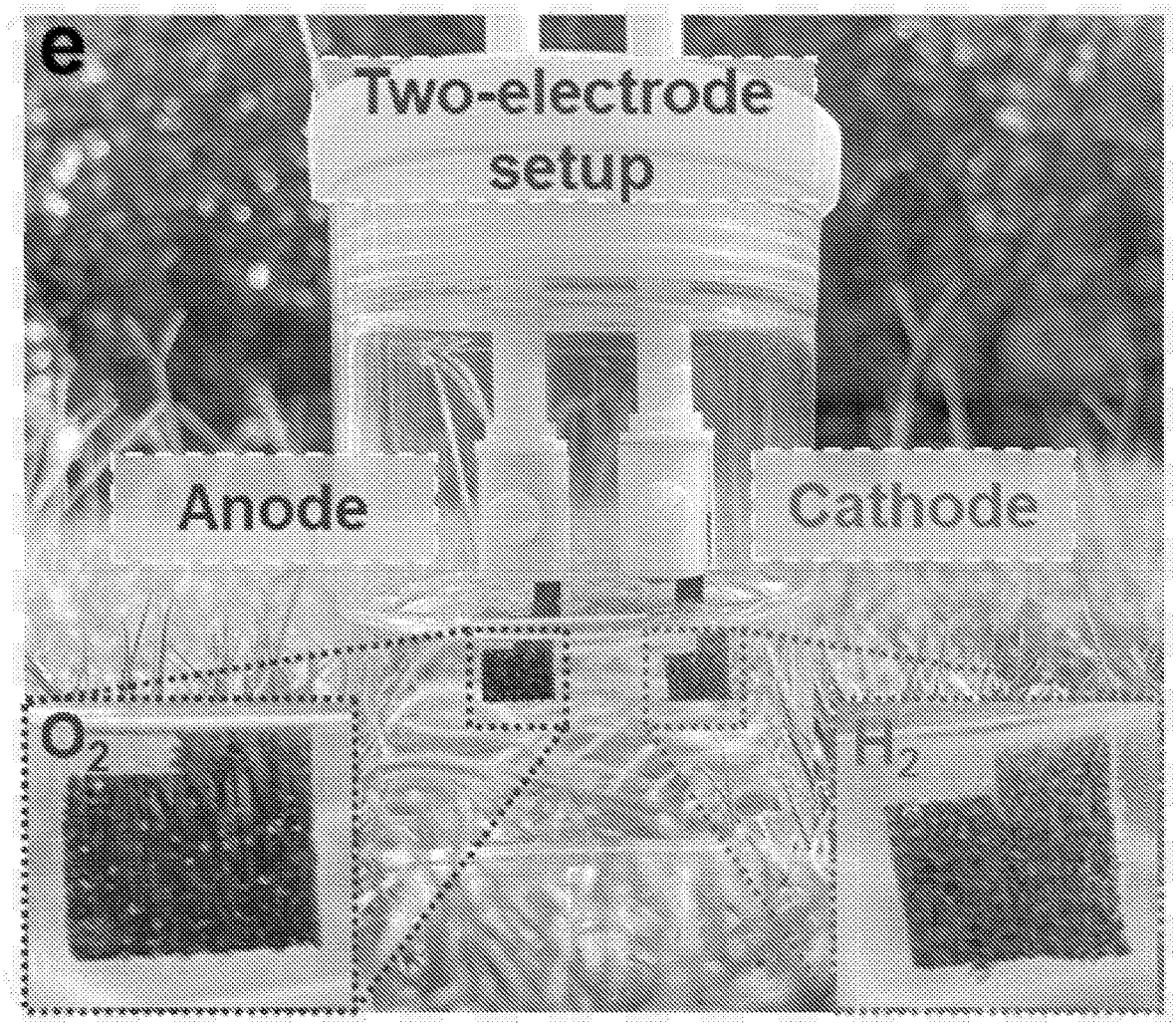
FIG. 5F is a magnified photograph of a two-electrode setup using an Ru-CMOP||Ru-CMOP couple and the electrodes during a reaction.

Moreover, the Ru-CMOP||Ru-CMOP two-electrode device is integrated with a commercial silicon solar cell for solar-driven water electrolysis (FIG. 5D and FIG. 5E). The Ru-CMOP||Ru-CMOP couple can be effectively powered by the solar panel at the potential real-time output of ~2.00 V under sunlight irradiation with enormous bubbles violently emerging from both electrodes (FIG. 5F). Therefore, a solar cell-driven overall water-splitting device can be efficiently and robustly achieved by the Ru-CMOP couple, demonstrating that the Ru-CMOP possesses a good potential as a bifunctional electrocatalyst for industrial applications.

According to an aspect of the present disclosure, there is provided an electrolyzer including a cathode including Ru-CMOP and an anode including Ru-CMOP. In an example, the electrolyzer further includes a solar cell. Non-limiting examples of a solar cell include amorphous silicon solar cell, thin-film solar cell, perovskite solar cell, and the like.

In an example, the electrolyzer includes a catalyst as described hereinabove. In another example, the electrolyzer includes a catalyst made by the method described hereinabove. In yet another example, the catalyst includes Ru-CMOP as described hereinabove. In still another example, the Ru-CMOP includes a support, a plurality of Ru-doped $CoMoO_4$ nanosheet arrays (Ru-CMO) assembled on the support; and a plurality of phosphide nanodomains (Ru-CMP) on the Ru-doped $CoMoO_4$ nanosheet arrays.

In an example, the Ru-CMOP of the electrolyzer described hereinabove exhibits (i) overpotentials of about 114+5 mV at −100 mA $cm^{-2}$ and about 183+10 mV at −500 mA $cm^{-2}$ for hydrogen evolution reaction; and (ii) overpotentials of about 286+5 mV at 100 mA $cm^{-2}$ and about 351+10 mV at 500 mA $cm^{-2}$ for oxygen evolution reaction. In another example, the Ru-CMOP of the electrolyzer described hereinabove is durable at about 250+10 mA $cm^{-2}$ for about 100 to 120 hours, including all ranges, subranges, and values therein, e.g., about 100 hours to about 110 hours, about 110 hours to about 120 hours, about 100 hours to about 105 hours, about 105 hours to about 110 hours, about 110 hours to about 115 hours, about 115 hours to about 120 hours, about 100 hours, about 102 hours, about 105 hours, about 110 hours, about 116 hours, about 120 hours, etc.

EXAMPLES

Chemicals and Materials

In an example, cobalt nitrate hexahydrate ($Co(NO_3)_2 \cdot 6H_2O$), ammonium molybdate tetrahydrate ($(NH_4)_6Mo_7O_{24} \cdot 4H_2O$), urea ($CO(NH_2)_2$), and potassium hydroxide (KOH) were purchased from Meryer Chemical Technology CO., Ltd. Ruthenium trichloride hydrate ($RuCl_3 \cdot_x H_2O$) and sodium dihydrogen hypophosphite ($NaH_2PO_2$) were purchased from Sigma-Aldrich Co., Ltd. Nickel foam (NF) was purchased from Fuel Cell Store Co. All the chemicals that were used are analytic grade or better and were used as received without any further purification. Deionized water (DI water) used in the experiments was obtained from local sources.

Synthesis of Ru-CMO

The ruthenium (Ru) doped $CoMoO_4$ nanosheet arrays (Ru-CMO) supported on NF were synthesized by a facile solvothermal method. The commercial NF was cut into a rectangular shape, with the size of 1×3 $cm^2$. The pieces of NF were sequentially cleaned in HCl (2 M), acetone, ethanol, and DI water for 15 min by sonication. 0.75 mmol of $Co(NO_3)_2 \cdot 6H_2O$, 0.25 mmol of $(NH_4)_6Mo_7O_{24} \cdot 4H_2O$, 5 mmol of $CO(NH_2)_2 \cdot 10$ μL of $RuCl_3 \cdot_x H_2O$ solution (2 mg/mL) were added into 25 mL of DI water. After being stirred for 1 h, the obtained homogenous solution was transferred into a 50 mL Teflon-lined autoclave with a piece of tailored NF tilted in the autoclave, which was then sealed and heated at 180° C. for 12 h. After cooling to room temperature, the NF was taken out by a tweezer, rinsed with water thoroughly, and dried at 60° C. in an oven overnight.

Synthesis of Ru-CMOP $NaH_2PO_2$ powder in a quartz boat was placed at the upstream side of the furnace with a mass loading of 100 mg. The NF loaded by Ru-CMO precursor was placed at the downstream side of the furnace. Then, the samples were annealed at 300° C. for 2 h under Ar atmosphere at a ramping rate of 5° C. $min^{-1}$. After the furnace naturally cooled down to room temperature, the final material for Ru doped CoMoP (Ru-CMP) generated on the Ru-CMO nanosheets was obtained, which was denoted as Ru-CMOP.

Synthesis of CMO

The synthesis procedure of pure $CoMoO_4$ nanosheet arrays (CMO) supported on NF was the same as that of Ru-CMO except for no addition of $RuCl_3 \cdot_x H_2O$.

Synthesis of CMOP

The synthesis procedure of CMOP was the same as that of Ru-CMOP except for using CMO as a precursor to replace the Ru-CMOP.

Characterizations

The scanning electron microscopy (SEM) was carried out on the FEI Quanta 450 equipment. The transmission electron microscopy (TEM), high-resolution TEM (HRTEM), high-angle annular dark-field scanning TEM (HAADF-STEM), selected-area electron diffraction (SAED), and elements mapping analysis were conducted by using a JEM-2100F instrument at an accelerating voltage of 200 kV. X-ray diffraction (XRD) patterns were collected on a Bruker D8 Advance powder diffractometer. X-ray photoelectron spectroscopy (XPS) was recorded by Thermo Fisher ESCALAB 250Xi equipment. Depth-profiling XPS spectra were conducted via argon sputtering (3 kV, 2 μA energy). All binding energies were calibrated by the C 1 s peak at 284.6 eV. Raman measurement was carried out on a WITec alpha300 R Raman System with a laser wavelength of 532 nm.

Electrochemical Tests

All electrochemical measurements were conducted by a standard three-electrode setup on an electrochemical workstation (CHI 760E). The electrolyte was 1 M KOH (pH=13.8). The sample on NF was directly used as a working electrode. The geometric surface area of 0.5 $cm^2$ (i.e., 0.5 cm×1 cm) was immersed into the electrolyte. An Ag/AgCl electrode and a graphite rod were employed as reference and counter electrodes, respectively. For the Pt/C and $RuO_2$ powder as benchmark samples, 5 mg Pt/C (commercial 20% Pt/C) or 5 mg $RuO_2$ was dispersed in a mixture of 50 μL Nafion solution (5 wt %) and 450 μL ethanol under sonication for 2 h to form a homogeneous ink. Then, 50 μL ink was drop-casted onto the surface of NF (0.5 cm×1 cm) with a mass loading of 1 mg $cm^{-2}$ for Pt/C or $RuO_2$ and dried at ambient temperature.

Before the electrochemical measurement, the electrolyte was bubbled with Ar flow for 30 min and the catalysts were activated with numerous cyclic voltammetry (CV) cycles until they were stable. The linear sweep voltammetry (LSV) curves for HER and OER were measured at a scan rate of 5 mV $s^{-1}$. All polarization curves were exhibited with iR correction unless otherwise mentioned. iR correction was conducted by the formula: $E_{iR}=E_0-i \times R_s$, where the solution resistance (i.e., $R_s$) was measured through electrochemical impedance spectroscopy (EIS). EIS measurement was conducted from 0.01 to 100000 Hz with an amplitude of 5 mV at −0.14 V vs. RHE for HER and at 1.51 V vs. RHE for OER. CV curves were collected at different scan rates (i.e., 20, 40, 60, 80, and 100 mV $s^{-1}$) in the potential range of 0.10 to 0.20 vs. RHE to evaluate the double-layer capacitance ($C_{dl}$) values for HER and from 1.00 to 1.10 vs. RHE for OER. The long-term stability of catalysts was evaluated using the chronopotentiometry (CP) test at −250 mA $cm^{-2}$ for HER and at 250 mA $cm^{-2}$ for OER without iR compensation. Besides, the overall water splitting performance was evaluated in 1 M KOH using a two-electrode configuration. For overall water splitting, the long-term stability test was evaluated by CP test at 250 mA $cm^{-2}$ without iR compensation. During these long-term CP tests, 1 mL of electrolyte was periodically added into the system for the compensation of water consumption for every 24 h. All potentials were normalized to the RHE according to the Nernst equation: E (vs. RHE)=E (vs. Ag/AgCl)+0.197 V+0.0591 V×pH.

Theoretical Computation Details

The first-principal calculation based on density functional theory is realized by the Vienna Ab-initio Simulation Package (VASP) code [Perdew, J. P.; Burke, K.; Ernzerhof, M., Generalized Gradient Approximation Made Simple. *Phys. Rev. Lett.* 1996, 77 (18), 3865-3868 and Kresse, G.;

Furthmüller, J., Efficient Iterative Schemes for Ab Initio Total-Energy Calculations Using a Plane-Wave Basis Set. *Phys. Rev. B* 1996, 54 (16), 11169-11186] with the full-potential projected augmented wave (PAW) formalism [Blöchl, P. E., Projector Augmented-Wave Method. *Phys. Rev. B* 1994, 50 (24), 17953-17979]. The exchange-functional is treated using the generalized gradient approximation (GGA) of Perdew-Burke-Ernzerhof (PBE) functional [Kresse, G.; Joubert, D., From Ultrasoft Pseudopotentials to the Projector Augmented-Wave Method. *Phys. Rev. B* 1999, 59 (3), 1758-1775]. Grimme's DFT-D2 functional is used to evaluate the dispersive van der Waals interactions between composites. A vacuum layer of 20 Å is applied to avoid perturbations from neighboring layers. The cut-off energy for the plane-wave expansion is set to 450 eV. A convergence criterion of $10^{-5}$ eV is set for self-consistence and the structure is relaxed until the maximum stress on each atom is lower than 0.01 eV/Å. The Γ-centered k-point mesh of 5×5×1 is used for density of states (DOS) calculation. Due to the inaccuracy of exchange-correction potential in dealing with d electrons of transitional metals, the Hubbard corrections (DFT+U) is employed. The U values are 4.41, 4.50, and 4.00 for Co, Mo, and Ru elements, respectively.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has" and "having"), "include" (and any form of include, such as "includes" and "including"), "contain" (and any form contain, such as "contains" and "containing"), and any other grammatical variant thereof, are open-ended linking verbs. As a result, a method or article that "comprises", "has", "includes" or "contains" one or more steps or elements possesses those one or more steps or elements, but is not limited to possessing only those one or more steps or elements. Likewise, a step of a method or an element of an article that "comprises", "has", "includes" or "contains" one or more features possesses those one or more features, but is not limited to possessing only those one or more features.

Terms like "obtainable" or "definable" and "obtained" or "defined" are used interchangeably. This, for example, means that, unless the context clearly dictates otherwise, the term "obtained" does not mean to indicate that, for example, an embodiment must be obtained by, for example, the sequence of steps following the term "obtained" though such a limited understanding is always included by the terms "obtained" or "defined" as a preferred embodiment.

Approximating language, as used herein throughout disclosure, may be applied to modify any quantitative representation that could permissibly vary without resulting in a change in the basic function to which it is related. Accordingly, a value modified by a term or terms, such as "about" or "substantially," is not limited to the precise value specified. For example, these terms can refer to an amount that is within ±10% of the recited value, an amount that is within ±5% of the recited value, less than or equal to ±2%, an amount that is within ±1% of the recited value, an amount that is within ±0.5% of the recited value, an amount that is within ±0.2% of the recited value, an amount that is within ±0.1% of the recited value, or an amount that is within ±0.05% of the recited value. In some instances, the approximating language may correspond to the precision of an instrument for measuring the value.

All publications cited in this specification are herein incorporated by reference as if each individual publication were specifically and individually indicated to be incorporated by reference herein as though fully set forth.

Subject matter incorporated by reference is not considered to be an alternative to any claim limitations, unless otherwise explicitly indicated.

Where one or more ranges are referred to throughout this specification, each range is intended to be a shorthand format for presenting information, where the range is understood to encompass each discrete point within the range as if the same were fully set forth herein.

While several aspects and embodiments of the present disclosure have been described and depicted herein, alternative aspects and embodiments may be affected by persons having ordinary skill in the art to accomplish the same objectives. Accordingly, this disclosure and the appended claims are intended to cover all such further and alternative aspects and embodiments as fall within the true spirit and scope of the present disclosure.

What is claimed is:

1. A method of making a catalyst, comprising:

forming a plurality of Ru-doped $CoMoO_4$ nanosheets on a support by a solvothermal process; and treating the plurality of supported Ru-doped $CoMoO_4$ nanosheets with a phosphorous source to create phosphide nanodomains, wherein the solvothermal process comprises:

providing the support;

mixing a Co source, a Mo source, and a Ru source to form a solution;

heating the solution and the support together at a temperature in a range from about 160 to 180° C. for about 10 to 12 hours, thereby obtaining a plurality of supported Ru-doped $CoMoO_4$ nanosheets; and cooling the plurality of supported Ru-doped $CoMoO_4$ nanosheets to room temperature.

2. The method of claim 1, wherein the support is a nickel foam or a carbon fiber paper.

3. The method of claim 1, wherein the Co source is water-soluble cobalt salt.

4. The method of claim 1, wherein the Co source is cobalt nitrate hexahydrate ($Co(NO_3)_2 \cdot 6H_2O$).

5. The method of claim 1, wherein the Mo source is a water-soluble molybdate salt.

6. The method of claim 1, wherein the Mo source is ammonium molybdate tetrahydrate ($(NH_4)_6Mo_7O_{24} \cdot 4H_2O$).

7. The method of claim 1, wherein the Ru source is ruthenium chloride hydrate ($RuCl_3 \cdot xH_2O$).

8. The method of claim 1, wherein treating comprises annealing the plurality of supported Ru-doped $CoMoO_4$ nanosheets and the phosphorous source at a temperature in a range from about 280 to 300° C. for about 1 to 2 hours under Ar atmosphere at a ramping rate of about 5° C. $min^{-1}$ and cooling to room temperature.

9. The method of claim 1, wherein the phosphorous source is a hypophosphite.

10. The method of claim 1, wherein the phosphorous source is sodium hypophosphite $NaH_2PO_2$.

11. The method of claim 1, wherein the phosphide nanodomains have an average diameter of about 4 to about 8 nm.

12. The method of claim 1, wherein after treating, the plurality of supported Ru-doped $CoMoO_4$ nanosheets have a thickness of about 10 to 15 nm.

13. A catalyst comprising:

a support;

a plurality of Ru-doped $CoMoO_4$ nanosheet arrays assembled on the support; and a plurality of phosphide nanodomains on the plurality of Ru-doped $CoMoO_4$ nanosheet arrays.

14. The catalyst of claim 13, wherein:

(i) the support is a nickel foam or a carbon fiber paper;

(ii) the plurality of phosphide nanodomains have an average diameter of about 4 to 8 nm; and (iii) the catalyst has a thickness of about 10 to 15 nm.

15. An electrolyzer comprising:

a cathode comprising Ru-CMOP; and an anode comprising Ru-CMOP.

16. The electrolyzer of claim 15, further comprising a solar cell.

17. The electrolyzer of claim 15, wherein Ru-CMOP comprises:

a support;

a plurality of Ru-doped $CoMoO_4$ nanosheet arrays assembled on the support; and a plurality of phosphide nanodomains on the plurality of Ru-doped $CoMoO_4$ nanosheet arrays.

18. The electrolyzer of claim 17, wherein:

(i) the support is a nickel foam or a carbon fiber paper;

(ii) the plurality of phosphide nanodomains have an average diameter of about 4 to 8 nm; and (iii) Ru-CMOP has a thickness of about 10 to 15 nm.

19. The electrolyzer of claim 15, wherein Ru-CMOP exhibits (i) overpotentials of about 114±5 mV at −100 mA $cm^{-2}$ and about 183±10 mV at −500 mA $cm^{-2}$ for hydrogen evolution reaction; and (ii) overpotentials of about 286±5 mV at 100 mA $cm^{-2}$ and about 351±10 mV at 500 mA $cm^{-2}$ for oxygen evolution reaction.

20. The electrolyzer of claim 15, wherein Ru-CMOP is durable at about 250±10 mA $cm^{-2}$ for about 100 to 120 hours.

* * * * *